US011431101B2

(12) United States Patent
Sledkov

(10) Patent No.: US 11,431,101 B2
(45) Date of Patent: Aug. 30, 2022

(54) ARTIFICIAL DIELECTRIC MATERIAL AND FOCUSING LENSES MADE OF IT

(71) Applicant: Vasant Limited, Wellington (NZ)

(72) Inventor: Victor Aleksandrovich Sledkov, Wellington (NZ)

(73) Assignee: VASANT LIMITED, Wellington (NZ)

( * ) Notice: Subject to any disclaimer, the term of this patent is extended or adjusted under 35 U.S.C. 154(b) by 0 days.

(21) Appl. No.: 17/595,535

(22) PCT Filed: Jan. 15, 2021

(86) PCT No.: PCT/NZ2021/050003

§ 371 (c)(1),
(2) Date: Nov. 18, 2021

(87) PCT Pub. No.: WO2021/145780

PCT Pub. Date: Jul. 22, 2021

(65) Prior Publication Data

US 2022/0209418 A1 Jun. 30, 2022

(30) Foreign Application Priority Data

Jan. 17, 2020 (NZ) ..... 760969

(51) Int. Cl.
*H01Q 15/10* (2006.01)
*H01Q 15/04* (2006.01)

(52) U.S. Cl.
CPC ..... *H01Q 15/10* (2013.01); *H01Q 15/04* (2013.01)

(58) Field of Classification Search
CPC ..... H01Q 15/10; H01Q 15/04
See application file for complete search history.

(56) References Cited

U.S. PATENT DOCUMENTS

| | | | | |
|---|---|---|---|---|
| 9,123,998 | B1 * | 9/2015 | LoRe | H01Q 1/422 |
| 11,075,452 | B2 * | 7/2021 | Crouch | H01Q 1/48 |
| 2010/0066639 | A1 | 3/2010 | Ngyuen et al. | |
| 2011/0003131 | A1 * | 1/2011 | Matitsine | C08J 9/35 428/300.1 |

(Continued)

OTHER PUBLICATIONS

International Search Report in International Application No. PCT/NZ2021/050003, dated Mar. 11, 2021.

(Continued)

*Primary Examiner* — Awat M Salih
(74) *Attorney, Agent, or Firm* — Heslin Rothenberg Farley & Mesiti, P.C.

(57) ABSTRACT

Provided herein is an artificial dielectric material comprising a plurality of sheets of a dielectric material and a plurality of conductive elements disposed in holes made in the sheets of the dielectric material, wherein each conductive element is a three-dimensional object consisting of side plates connected to a central support and disposed to form conductive surfaces surrounding an empty space. Also provided are conductive elements and focusing lenses comprising the artificial dielectric materials and conductive elements along with methods for manufacture of such materials and method for their use. The artificial dielectric materials, lenses and their manufacture may provide desirable dielectric and radio wave focusing properties compared with known materials and manufacturing advantages.

40 Claims, 20 Drawing Sheets

(56) References Cited

U.S. PATENT DOCUMENTS

| | | | |
|---|---|---|---|
| 2012/0146881 | A1 | 6/2012 | McKinzie, III |
| 2013/0002253 | A1 | 1/2013 | Werner et al. |

OTHER PUBLICATIONS

Written Opinion in International Application No. PCT/NZ2021/050003, dated Mar. 11, 2021.
International Preliminary Report on Patentability in International Application No. PCT/NZ2021/050003, dated Aug. 13, 2021.

* cited by examiner

ARTIFICIAL DIELECTRIC MATERIAL AND FOCUSING LENSES MADE OF IT

CROSS-REFERENCE TO RELATED APPLICATIONS

The present invention application is a U.S. National Phase filing under 35 U.S.C. § 371 of International Application No. PCT/NZ2021/050003, filed Jan. 15, 2021, which claims priority from New Zealand patent application 760969, filed Jan. 17, 2020. The entire contents of each of these prior applications are hereby incorporated herein by reference.

FIELD OF THE INVENTION

The present invention relates to artificial dielectric materials comprising conductive elements and focusing lenses made thereof for electromagnetic waves.

BACKGROUND

Modern mobile communication market needs multi beams antennas creating narrow beams and operating in different frequency bands. Focusing dielectric lens is the main part of the most efficient multi beam antennas. Diameter of a focusing lens has to be several wave length of electromagnetic wave spreading through a lens to create a narrow beam, therefore some lenses of multi beam antennas for mobile communication have diameter more than 1 m. Such lenses made of usual dielectric materials are too heavy, therefore much research was done to create lightweight and low loss lenses providing desirable properties of focusing lenses.

The most well-known lightweight artificial dielectric materials consist of randomly oriented conductive parts mixed with nonconductive parts made of lightweight dielectric material. It is very difficult to manufacture uniform material having desirable dielectric properties by randomly mixing of conductive and nonconductive parts, therefore a focusing lens is the most expensive component of multi-beam antennas. To improve properties and decrease cost of focusing lenses development of such materials is constantly continuing.

U.S. Pat. No. 8,518,537 B2 describes the lightweight artificial dielectric material comprising plurality of randomly orientated small elements of lightweight dielectric material like polyethylene foam containing conductive fibers placed inside of each element.

Patent application US 2018/0034160 A1 describes the lightweight artificial dielectric material comprising plurality of randomly orientated small multilayer elements of lightweight dielectric material containing thin conductive patches between layers. This document describes that such multilayer elements provide more dielectric permittivity than elements containing conductive fibers.

Patent application US 2018/0279202 A1 describes other kinds of the lightweight artificial dielectric material comprising plurality of randomly orientated small elements. One described material includes small multilayer elements of lightweight dielectric material containing thin conductive sheets between layers.

All lightweight artificial dielectric materials mentioned above are made by random mixing of small elements. Elimination of metal-to-metal contacts within the material that could lead to passive intermodulation distortion is needed, therefore manufacturing of such materials comprises many stages and its cost is high.

Randomly mixing provides isotropic properties of a final material consisting of small elements but some applications need dielectric material having anisotropic properties. For example cylindrical lens made of anisotropic dielectric material can reduce depolarization of electromagnetic wave passed through cylindrical lens and improve cross polarization ratio of multi beam antenna (U.S. Pat. No. 9,819,094 B2). The cylindrical lens made of isotropic artificial dielectric material creates depolarization of the electromagnetic wave passed through such lens therefore an antenna comprising such lens can suffer from high cross polarization level.

A lightweight artificial dielectric material providing anisotropic properties and suitable for manufacturing cylindrical lens was described by the NZ patent application 752904, filed Apr. 25, 2019. This material consists of short conductive tubes having thin walls and placed inside of a lightweight dielectric material. Tubes are placed in layers. One layer comprises a sheet of a lightweight dielectric material containing plurality of holes. A lightweight dielectric material can be a foam polymer. Tubes are placed in holes made in a sheet of a lightweight dielectric material and contain air inside. Layers containing tubes are separated by layers of a lightweight dielectric material without tubes. The axes of all conductive tubes are directed in perpendicular from layers.

Such structure could have dielectric permittivity ($\varepsilon$) up to 2.5 for electromagnetic wave spreading along the axes of tubes but its $\varepsilon$ is significantly smaller for electromagnetic wave spreading in a perpendicular direction. The reason of such unwanted property of the known artificial dielectric material is the anisotropic property of the tubes.

It is desired to provide an improved light artificial dielectric material for manufacturing such devices as focusing lenses and antennas for radio communication. The provided material has to be simple for manufacturing and have repeatable properties.

SUMMARY OF INVENTION

In a first aspect of the invention, provided is an artificial dielectric material comprising a plurality of sheets of a dielectric material and a plurality of conductive elements disposed in holes made in the sheets of the dielectric material, wherein each conductive element is a three-dimensional object consisting of side plates connected to a central support and disposed to form conductive surfaces surrounding an empty space.

The side plates may be disposed either perpendicular or non-perpendicular to the support part.

The artificial dielectric material may have at least one surface of the conductive element covered by a dielectric film. Alternatively, at least one surface of the conductive element is covered by a conductive film.

The artificial dielectric material may have holes in the dielectric material which contain projections disposed in the gaps separating the outer parts of the conductive elements.

The artificial dielectric material may have a cruciform slot or a hole in the central support and/or one or more of the side plates.

The axes of the conductive elements of the artificial dielectric material are preferably orientated along at least two different directions, preferably at least two orthogonal directions.

The conductive elements of the artificial dielectric material may have at least two different shapes.

The conductive elements may have a shape of a half of an empty sphere containing slots cutting a surface of the sphere in order to provide side plates.

The dielectric material is preferably a foam polymer, most preferably polyethylene, polystyrene, polypropylene, polyurethane, silicon or polytetrafluoroethylene.

The conductive elements disposed in one layer may form a square lattice providing equal distances between neighboring tubes disposed at the same row or at the same column. Alternatively the conductive elements disposed in one layer may form a honeycomb (hexagonal) lattice providing equal distances between any neighboring elements.

The axes of the conductive elements disposed in one layer may be directed at the same direction. Such axes of the conductive elements disposed in one layer may be directed perpendicular to the layer. Such axes of the conductive elements disposed in one layer may directed parallel to the layer.

The axes of some conductive elements disposed in one layer may be directed perpendicular to the layer and axes of other conductive elements may be directed in parallel to the layer. The axes of the conductive elements directed in parallel to the layer may be directed in different directions.

According to another aspect of the invention, provided is a focusing lens comprising an artificial dielectric material comprising conductive elements according to the invention.

The focusing lens may include layers where the conductive elements of each layer form a sunflower (radial circle) lattice. The focusing lens may include at least one circle of a layer containing conductive elements having axes directed in parallel to the layer and in parallel to the circle. The focusing lens may include at least one circle of a layer containing conductive elements having axes directed in parallel to the layer and perpendicular to the circle.

The focusing lens may include layers with conductive elements having axes directed only perpendicular to the layer and layers containing conductive elements having axes directed only in parallel to the layer.

The focusing lens may include a layer containing conductive elements with axes directed only in parallel to the layer which are directed in perpendicular to axes of the conductive elements of another layer containing the conductive elements with axes directed in parallel to the layer.

The focusing lens may include each layer containing conductive elements with axes directed perpendicular to the layer and conductive elements with axes directed in parallel to the layer.

The focusing lens may include conductive elements with axes directed in parallel to the layer and displaced at even layers which are directed perpendicular to axes of conductive elements directed in parallel to the layer and displaced at odd layers.

The focusing lens may include each layer containing circles of conductive elements having axes directed perpendicular to the layer and circles of conductive elements having axes directed in parallel to the layer.

The focusing lens may include a dielectric rod placed along the longitudinal axis of the focusing lens.

The focusing lens may be cylindrical or may be spherical

Another aspect of the invention provides a method for manufacturing an artificial dielectric material according to the invention, the method comprising placing the conductive elements in a plurality of sheets of a dielectric material, and stacking said sheets together, wherein axes of the conductive elements are orientated along at least two different directions.

In the method, the conductive elements may be placed into pre-existing holes in the sheets of the dielectric material.

In the method the sheets of the dielectric material containing the conductive elements may be separated by sheets of the dielectric material without conductive elements.

The sheets of the dielectric material containing the conductive elements may comprise holes which do not pass through the thickness of the sheet.

The method may include the step of bending the outer parts of the conductive elements at the time of being placed into the sheets of the dielectric material.

Another aspect of the invention provides a conductive element for use in an artificial dielectric material, the element comprising side plates connected to a central support, disposed to form conductive surfaces surrounding an empty space.

The side plates may be disposed either perpendicular or non-perpendicular to the support part.

The side plates may be connected at the outer region of the central support.

A further aspect of the invention provides a method of focusing a radio wave using a focusing lens according to an embodiment of the invention.

By providing the above artificial dielectric material, the invention goes at least some way to overcoming deficiencies of the known lightweight artificial dielectric materials and to provide a light artificial dielectric material providing less dependence from direction and polarization of electromagnetic waves spreading through the material.

An electromagnetic wave propagating through an artificial dielectric material comprising conductive elements excites circular currents flowing on the conductive elements, therefore permeability of such materials is less than 1. This effect was described many years ago (W. E. Kock Metallic delay lenses.//Bell System Technical Journal, v.27, pp. 58-82, January 1948). When an electromagnetic wave propagates through a square or hexagonal lattice of conductive tubes in a direction along the axes of the tubes, delay coefficient (n) does not depend on polarization since any polarization excites the same circular currents. When an electromagnetic wave propagates through square or hexagonal lattice of conductive tubes in direction perpendicular the axes of the tubes n does depend on polarization. The biggest circular currents flow on a wall of the conductive tube in a direction perpendicular to axis of the conductive tube when a magnetic field of an electromagnetic wave is directed in parallel to the axis of the conductive tube. As a result, permeability for such polarization is significantly less than for other polarizations and delay coefficient n is also less than n for other polarizations. It is possible to increase delay coefficient n for such polarization by decreasing distance between the tubes disposed in a layer. Increasing capacity between the tubes disposed in the layer increases permittivity of the artificial dielectric material. As a result the known artificial dielectric material can provide very small difference between n for any polarization of electromagnetic wave spreading in a direction perpendicular to the axes of the conductive tubes but cannot provide the same n for other directions of electromagnetic wave.

Because n depends on the angle between the direction of an electromagnetic wave crossing the material and axes of the tubes, such artificial dielectric material does not suit for many applications requiring an isotropic dielectric material providing the same value of n for any direction and polarization of electromagnetic wave. For example spherical Luneburg lenses have to be made of isotropic dielectric material having the same n for any direction and polarization of electromagnetic wave to keep polarization of an electromagnetic wave passing through spherical lens. Therefore a need exists to create the artificial dielectric material providing less dependence n from direction and polarization of electromagnetic wave crossing the material in compare with the known material described by the NZ752904. At the same time manufacturing of such material has to be simpler than manufacturing of known lightweight artificial materials made by randomly mixing of small elements containing conductive elements isolated from each other.

The focusing properties of an artificial dielectric material such as a tube depend on delay coefficient $n=\sqrt{\varepsilon\mu}$ where $\mu$ is magnetic permeability.

As an electromagnetic wave passes through the known lightweight artificial dielectric material this excites currents in the conductive material and $\mu$ of such material is less than 1. The biggest circular currents flow on a wall of a conductive material such as a tube in a direction perpendicular to the axis of a conductive tube when the magnetic field of electromagnetic wave is directed in parallel to axis of a conductive tube. As a result $\mu$ for such polarization is less than for other polarizations and delay coefficient n is also less than for other polarizations. Artificial dielectric materials containing short tubes suffer from such effect, therefore it is needed to find other shapes of conductive elements to increase $\mu$ and delay coefficient n.

The artificial dielectric material according to the invention provides a light artificial dielectric material having less dependence on direction and polarization of electromagnetic waves spreading through the material.

DESCRIPTION OF THE DRAWINGS

In further describing the invention, reference is made to the accompanying drawings by way of example only in which.

Figure 10A:
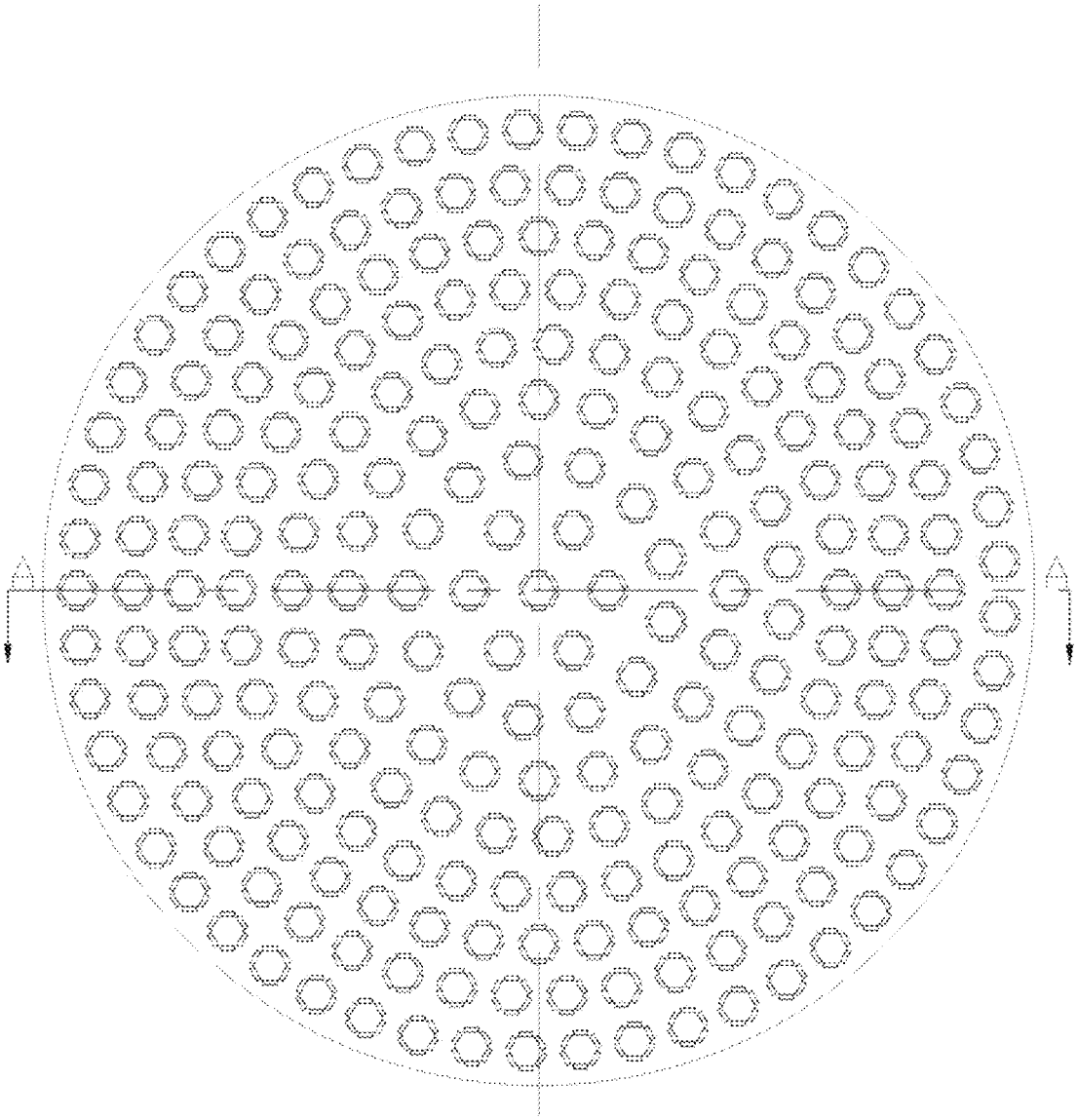
FIG. 10*a* shows the top view of the first layer of a cylindrical lens according to an embodiment of the invention.

Throughout the Figures, sectional lines A-A are used to indicate sections in corresponding drawings of the same set. For example, the section indicated in FIG. 10*a* is represented in by the first layer in FIG. 10*b*.

DETAILED DESCRIPTION OF THE INVENTION

As described and shown in the figures, the artificial dielectric material includes a plurality of conductive particles, described herein as conductive elements, disposed in holes made in sheets of a lightweight dielectric material. Each conductive element is a three-dimensional object consisting of thin parts (described herein as side plates) directly connected to the middle part (described herein as a central support) and forming an outer contour of the conductive element surrounding an empty space formed inside of the conductive element. Typically, the conductive element is made from a piece of a suitably conductive metal such as aluminium which is bent into the required shape. The metal may alternatively be copper, nickel, silver or gold.

Alternatively, a thin sheet of a lightweight resilient dielectric material formed into a required shape may be coated with a thin layer of conductive material in order to form the conductive element.

Some embodiments of the conductive element comprise a central support disposed at a horizontal plane and side plates connected to the outer contour or region of the central support and disposed at other planes turned by 30-90 degrees from the horizontal plane for example. Thus the relationship between the central support and the side plates may be perpendicular or non-perpendicular. The outer contour of the central support could be a polygon for example triangle, square, hexagon or octagon. The central support could contain holes. In the examples shown in the figures, the outer contour is typically shown as hexagonal by way of example only.

Other embodiments of the conductive element may include side plates which are not flat and are more robust than conductive elements having flat side plates. For example, the conductive element could be a half of an empty sphere having slots disposed across its diameter as shown in FIGS. 5*a* and 5*b*. Such a conductive element therefore has arcuate conductive elements. The conductive material may have at least one surface of the conductive element covered by a dielectric film.

The conductive elements are placed in layers. One layer comprises a sheet of the lightweight dielectric material containing plurality of holes filled by the conductive elements. The lightweight dielectric material can be a foam polymer. The foam polymer is preferably made of a material selected from polyethylene, polystyrene, polypropylene, polyurethane, silicon and polytetrafluoroethylene. The layers containing conductive elements are separated by layers of a dielectric material without conductive elements. The separating layers could be a foam polymer or a thin dielectric film. The separating layers also could contain holes having smaller diameter than diameter of holes for conductive elements to provide air ventilation through the lightweight dielectric material.

Figure 1A:
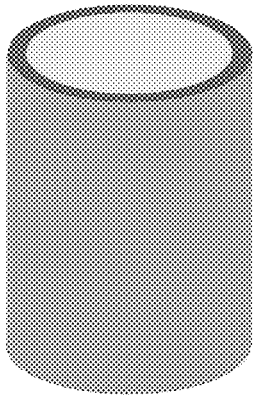
FIGS. 1*a*-1*c* show perspective views of short conductive tubes according to the prior art.
Figure 1B:
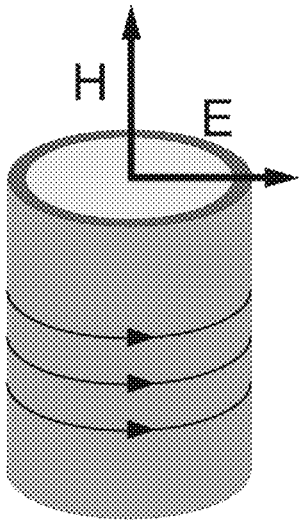
Figure 2A:
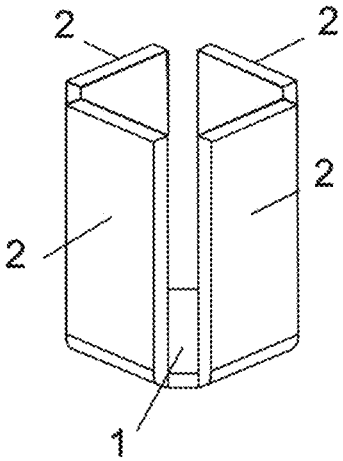
FIGS. 2*a*-2*c* show perspective views of conductive elements according to an embodiment of the invention.
Figure 2B:
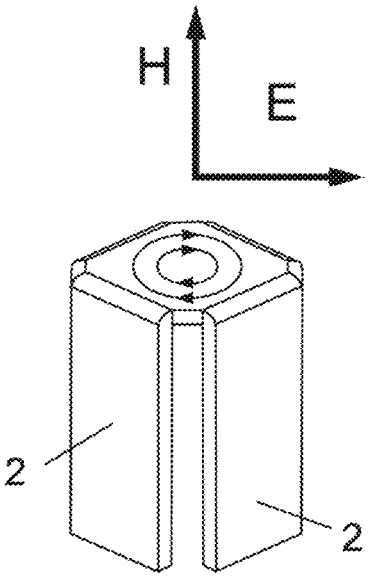
Figure 2C:
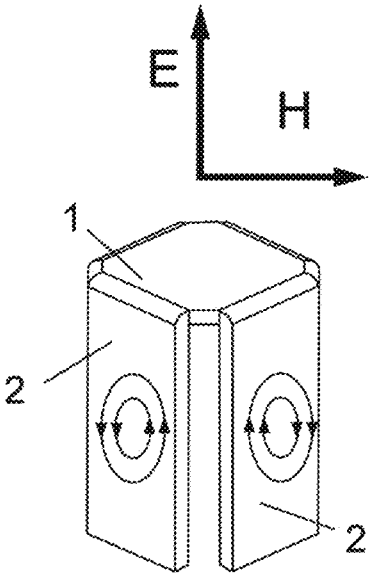

Two samples of the artificial dielectric material were manufactured to compare properties of proposed and known material. The first sample was made of the known material containing short conductive tubes shown in FIG. 1*a*. The second sample was made of the proposed material containing the conductive elements as shown in FIGS. 2*a* to 2*c* comprising the flat middle part or central support 1 disposed at horizontal plane and four side plate parts 2 connected to the outer contour of the central support and disposed at planes turned by 90 degrees from the horizontal plane as it is shown in FIG. 2*a*. Both samples of the artificial dielectric material have the same dimensions and contain the same quantity of conductive elements. Measurements of magnetic properties of the artificial dielectric material containing conductive elements shown in FIG. 2*a* did show increasing μ in comparison with the known artificial dielectric material containing short conductive tubes when a magnetic field of electromagnetic wave is directed in parallel to an axis of a conductive tube. The measured sample of the known artificial dielectric material has μ=0.69. FIG. 1*b* shows circular currents flowing on a wall of the tube when magnetic field of electromagnetic wave is directed in parallel to an axis of a conductive tube.

The measured sample of the artificial dielectric material in accordance with the present invention has μ=0.85 since circular currents cannot flow on side plates 2 separated by gaps when magnetic field of electromagnetic wave is directed in parallel to an axis of the conductive element and flow on the central support 1 only as it is shown in FIG. 2*b*.

Figure 1C:
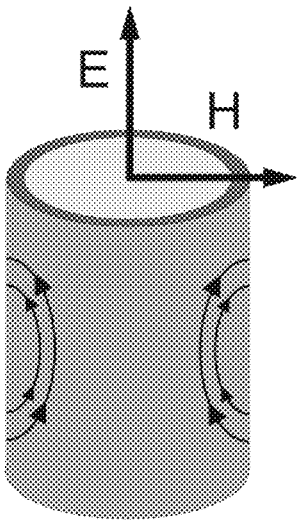

Difference of properties is smaller when magnetic field of electromagnetic wave is directed in perpendicular to an axis of a conductive tube and the conductive element. The measured sample of the known artificial dielectric material has μ=0.83. FIG. 1*c* shows circular currents flowing on a wall of the tube when magnetic field of electromagnetic wave is directed in perpendicular to an axis of a conductive tube. The measured sample of the artificial dielectric material in accordance with the present invention has μ=0.86. FIG. 2*c* shows circular currents flowing on side plates 2 of the conductive element when magnetic field of electromagnetic wave is directed in parallel to the base. Separation of side plates 2 from each other decreases such circular currents but does not eliminate them.

Both materials have almost the same c therefore the artificial dielectric material in accordance with the present invention has a bigger delay coefficient n and its dependence from polarization of electromagnetic wave is smaller.

Figure 3A:
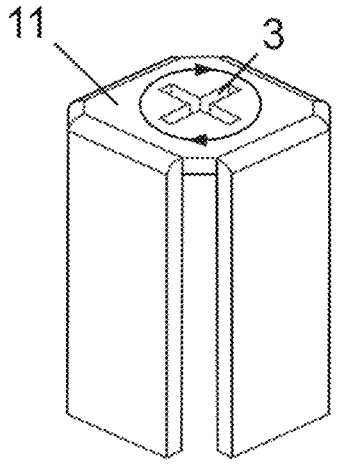
FIGS. 3*a*-3*d* show perspective views of conductive elements according to different embodiments of the invention.

Another embodiment of the present invention is shown in FIG. 3*a* where cruciform slot 3 has made in the central support 11 of the conductive element. Such slot limits circular currents flowing at the central area of the central support therefore circular currents can flow along the outer contour of the central support 11 only.

Figure 3B:
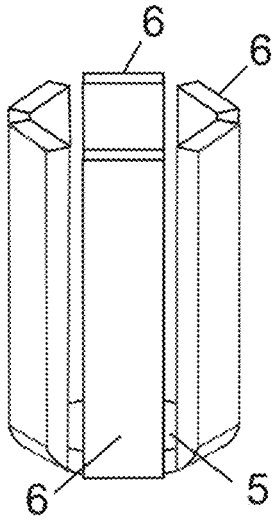

Another embodiment of the present invention is shown in FIG. 3*b* where a conductive element has the central support 5 in a shape of hexagon and six side plate parts 6. The side plates 6 are narrower than the side plates 2 of FIGS. 2*a* to 2*c*, therefore when the magnetic field of an electromagnetic wave is directed in parallel to the central support 5 circular currents flowing on the side plates 6 are less than those on the side plates 2 of the corresponding material shown in FIGS. 2*a* to 2*c*.

Figure 3C:
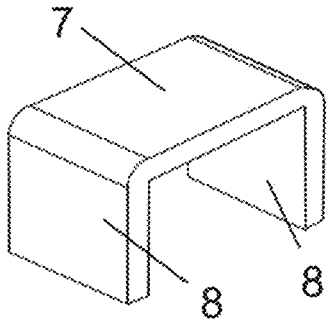

Another embodiment of the present invention is shown in FIG. 3*c*. The conductive element has the flat central support 7 in the shape of a rectangle disposed at horizontal plane and two side plate parts 8 connected to the outer contour of the central support and disposed at an angle of 90 degrees relative to the horizontal plane of central support 7.

Figure 3E:
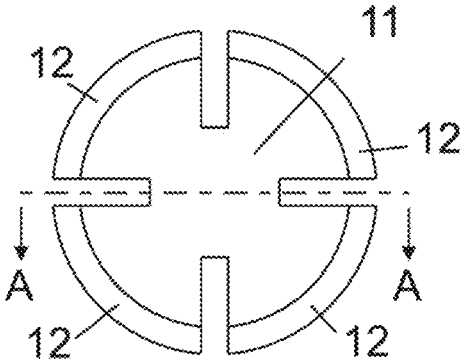
FIGS. 3*e* and 3*f* show a top view and a cross-section view, respectively, of a conductive element according to an embodiment of the invention.
Figure 3D:
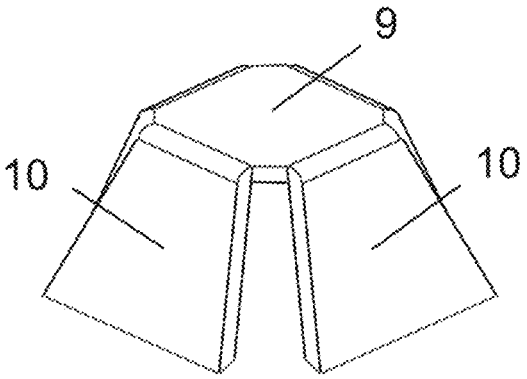

Another embodiment of the present invention is shown in FIG. 3*d*. The conductive element has the flat central support 9 in the shape of a square disposed at horizontal plane and four side plate parts 10 connected to the outer contour of the central support and disposed at an angle of 60 degrees relative to the horizontal plane of central support 9.

Figure 3F:
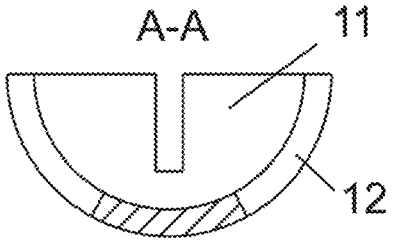

Another embodiment of the present invention is shown in FIGS. 3*e* and 3*f* in a top view and a cross section respectively. The conductive element is a half of an empty sphere having slots disposed across its diameter as depicted in FIG. 3*e* which separate the half sphere into side plate parts 12. The central support 11 and four side plates 12 are not flat therefore such element is more robust than the element shown in FIGS. 3*a* and 3*b*.

Figure 4A:
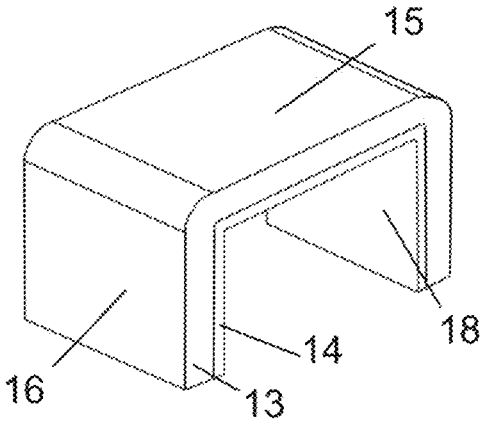
FIGS. 4*a* and 4*b* show perspective views of conductive elements according to embodiments of the invention.

Another embodiment of the present invention is shown in FIG. 4*a* where a thin sheet of a lightweight resilient dielectric material 13 formed into a required shape is coated with a thin layer or film of conductive material 14 in order to form the conductive element comprising the central support 15 and two side plates 16. Such coating could be by electrodeposition or rolling of the film. Thickness of the conductive element made in this way can be several microns only, therefore such element is very light. Such elements could be punched from a sheet of a dielectric film, coated by a conductive layer, and bent into the desired shape after punching. Bending could be done during installation the conductive element into holes.

Figure 4B:
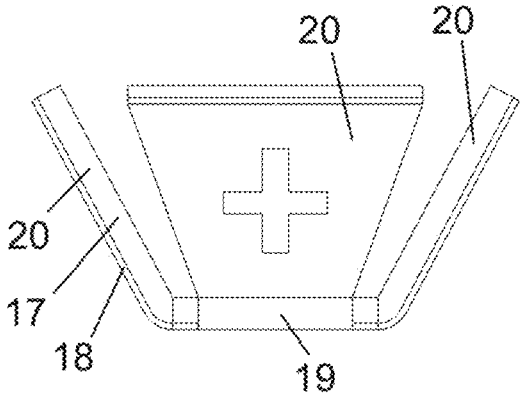

Another embodiment of the present invention is shown in FIG. 4*b* where a thin sheet of a lightweight resilient dielectric material 17 formed into a required shape is coated with a thin layer of conductive material 18 in order to form the conductive element comprising the central support 19 and four side plates 20. Cruciform slot 21 has made in the side plate 20 of the conductive element.

Alternatively, the conductive material may be similarly coated with a film or thin layer of a dielectric material in order to form a conductive element having a similar structure to that depicted in FIGS. 4*a* and 4*b*, yet made by a different process where the dielectric is provided by deposition or rolling.

Figure 5:
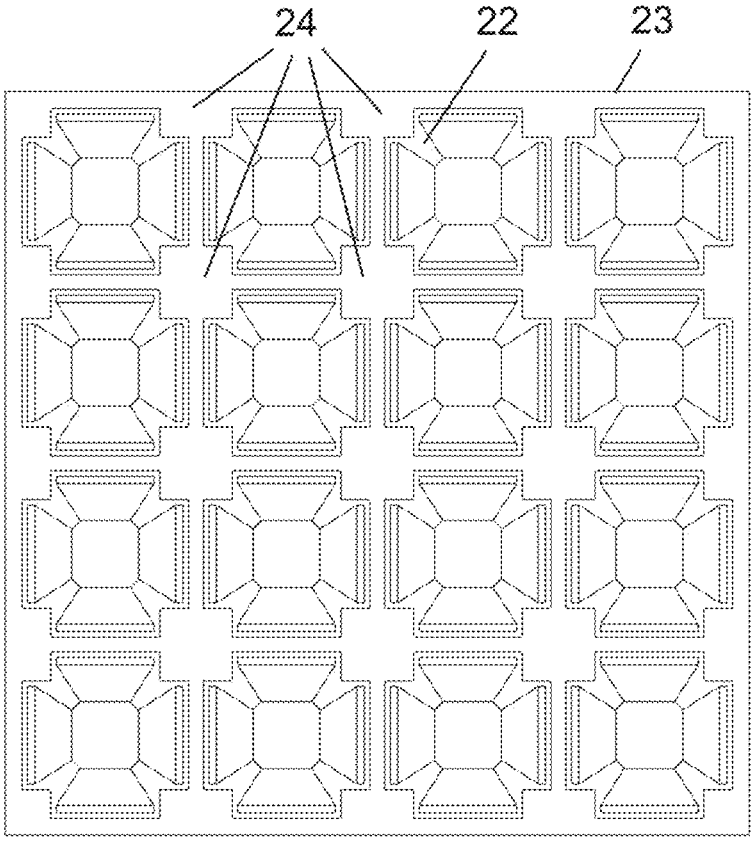
FIG. 5 shows a top view of conductive elements disposed in holes formed in a sheet of dielectric foam according to an embodiment of the invention.

Another embodiment of the present invention is shown in FIG. 5 where conductive elements from FIG. 3*d* are disposed in holes 22 made in a sheet of a lightweight dielectric material 23. Holes 22 contain projections 24 fixing positions of the side plates of the conductive element.

The conductive elements placed in neighboring layers could be disposed above each other on the same axes. Neighboring layers could be shifted from each other and then the conductive elements placed in neighboring layers have different axes.

The conductive elements could be disposed with different orientations of axes. Axes of some conductive elements are directed perpendicular to the layers and axes of other conductive elements are directed in parallel to the layers. The conductive elements having axes directed in parallel to the layers could have disposition of axes perpendicular to each other. Thus the axes of the conductive elements may have three orthogonal directions. As a result dielectric properties of the artificial dielectric material according to the invention are less dependent on direction and polarization of electromagnetic wave crossing the material.

The conductive elements placed in one layer could have the same orientation of axes or different orientation. Layers containing conductive elements placed above each other could have the same structure or different structures. Differing layers may include different spacing of conductive elements in the respective layers. For example, adjacent layers or sheets of the same size may with the conductive elements arranged in radial circles may have differing numbers of radial circles in order to increase the distance between the circles. Similarly, for honeycomb lattice arrangements, distances between adjacent conductive elements in the same layer may be varied.

Properties of the provided artificial dielectric material depend on orientation of the conductive elements and distances between these and between the layers. Therefore the provided artificial dielectric material comprising conductive elements having different orientation of axes in a layer and layers with different structures provides opportunity to reach desirable dielectric properties compared with known materials. For example it is possible to decrease dependence of delay coefficient n from direction and polarization of electromagnetic waves passing through the provided artificial dielectric material. As a result the provided artificial dielectric material can be applied for manufacturing of many kinds of focusing lenses and antennas.

Several embodiments of the present invention are shown in FIGS. 6*a*-6*h* where conductive elements shown in FIG. 3*b* disposed in one layer form different layer structures.

Figure 6A:
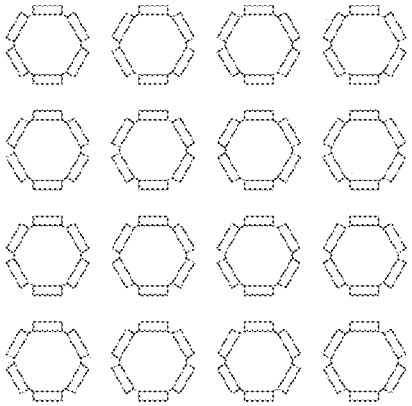
FIGS. 6*a*-6*h* show a range of top views of embodiments of the present invention where conductive elements shown in FIG. 3*b* are disposed in one layer and form different structures.

FIG. 6*a* shows the top view of a layer containing conductive elements placed in rows where axes of conductive elements are perpendicular to the layer and distances between conductive elements of neighboring rows and distances between neighboring conductive elements of one row are equal.

Figure 6B:
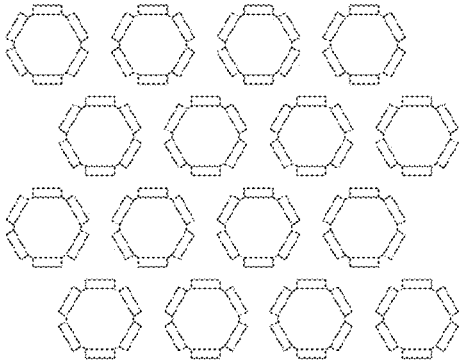

FIG. 6*b* shows the top view of a layer containing conductive elements placed in rows where axes of conductive elements are perpendicular to layer. The rows are shifted by half of a distance between neighboring conductive elements placed in one row and distances between any neighboring conductive elements are equal.

Figure 6C:
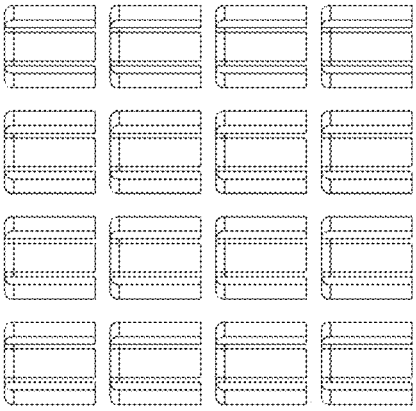

FIG. 6*c* shows the top view of a layer containing conductive elements placed in rows where axes of all conductive elements are in parallel to the layer and in parallel to each other.

Figure 6D:
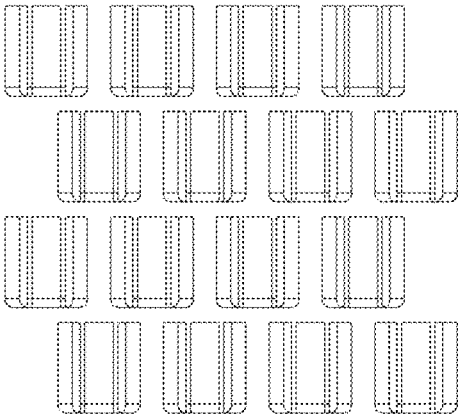

FIG. 6*d* shows the top view of a layer containing conductive elements placed in rows where axes of conductive elements are in parallel to the layer and in parallel to each other. Rows are shifted by half of a distance between neighboring conductive elements placed in one row.

Figure 6E:
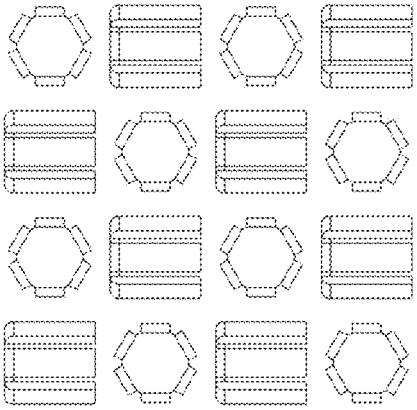

FIG. 6*e* shows the top view of a layer containing conductive elements placed in rows where axes of conductive elements alternate, with one half of the conductive elements directed perpendicular to the layer and axes of the other half of conductive elements directed in parallel to layer. Each row contains conductive elements with axes directed perpendicular to the layer and conductive elements with axes directed in parallel to the layer.

Figure 6F:
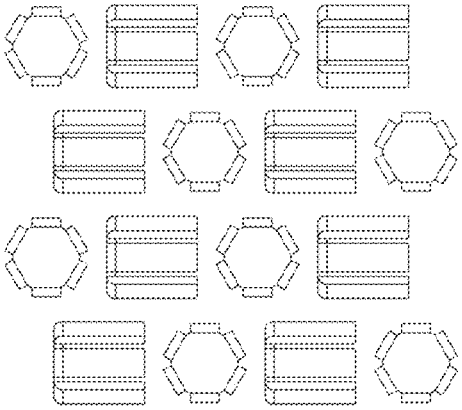

FIG. 6*f* shows the top view of a layer containing conductive elements placed in rows where axes of conductive elements alternate, where axes of one half of conductive elements are directed perpendicular to layer and the axes of other half of conductive elements are directed in parallel to layer. Each row contains conductive elements with axes directed perpendicular to layer and conductive elements with axes directed in parallel to layer. The neighboring rows are shifted by half of a distance between of neighboring rows.

Figure 6G:
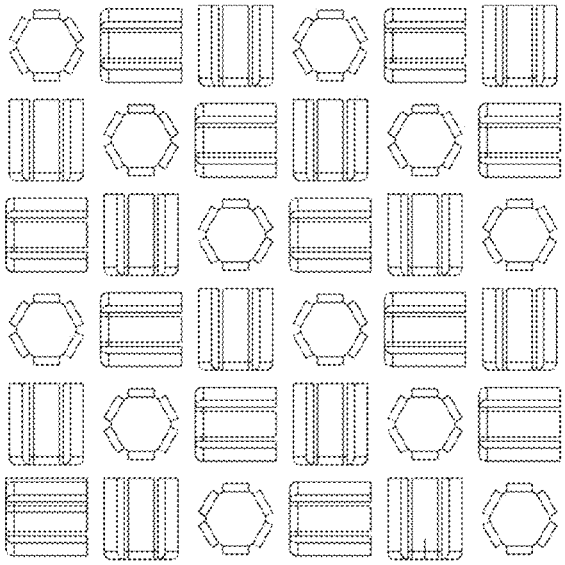

FIG. 6*g* shows the top view of a layer containing conductive elements placed in rows where axes of one third of the conductive elements are directed perpendicular to layer and axes of the other conductive elements are directed in parallel to layer. Of the conductive elements with axes directed in parallel the layer, axes of one half of these are directed perpendicular to axes of the other half of the conductive elements with axes directed in parallel the layer.

Figure 6H:
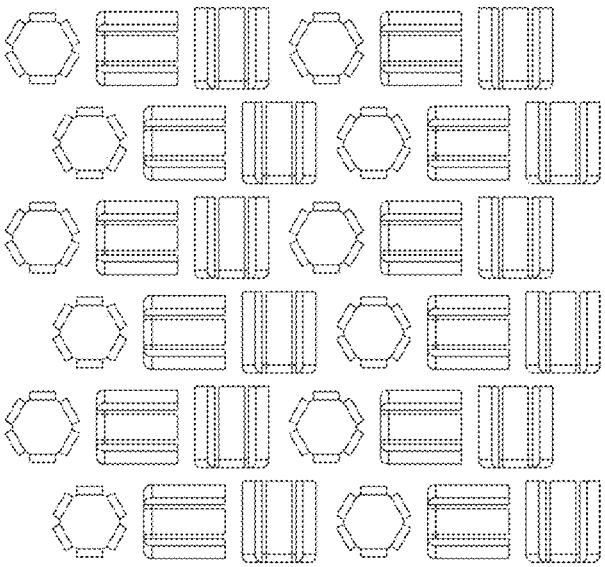

FIG. 6*h* shows the top view of a layer containing conductive elements placed in rows where axes of one third of conductive elements are directed perpendicular to layer and axes of other conductive elements are directed in parallel to layer. Of the conductive elements with axes directed in parallel the layer, axes of one half of these are directed perpendicular to axes of the other half of the conductive elements with axes directed in parallel the layer. The neighboring rows are shifted on half of a distance between of neighboring rows.

Conductive elements having other shapes such as shown in FIGS. 2*a*-5*b* could also be disposed as it is shown in FIGS. 6*a*-6*h*.

Several embodiments of a cylindrical lens and layers which may form it made of the artificial dielectric material according to the invention are described below.

Figure 7A:
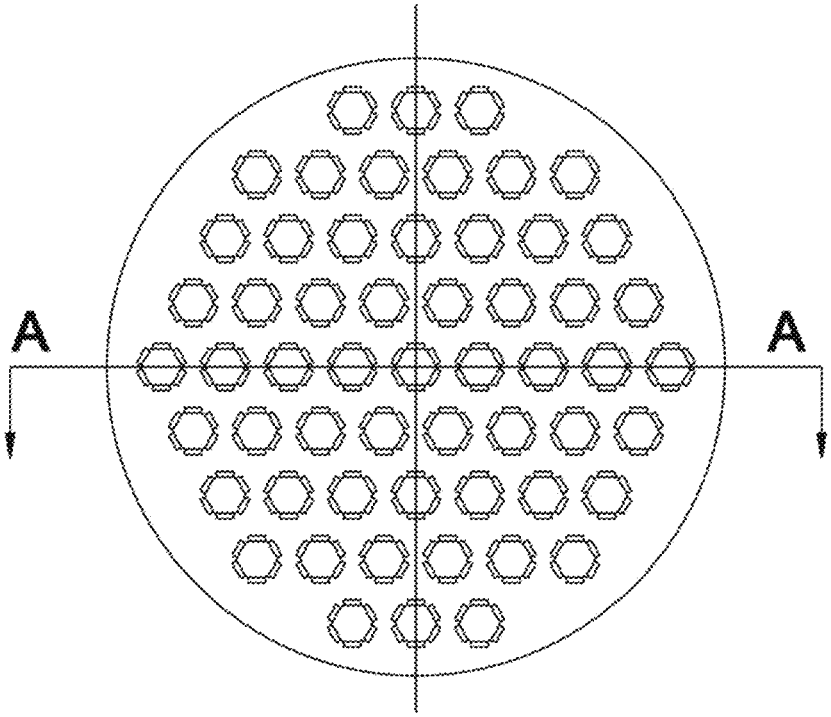
FIGS. 7*a*-7*c* show top views of the first, second and third layers, respectively of a cylindrical lens according to the invention.
Figure 7B:
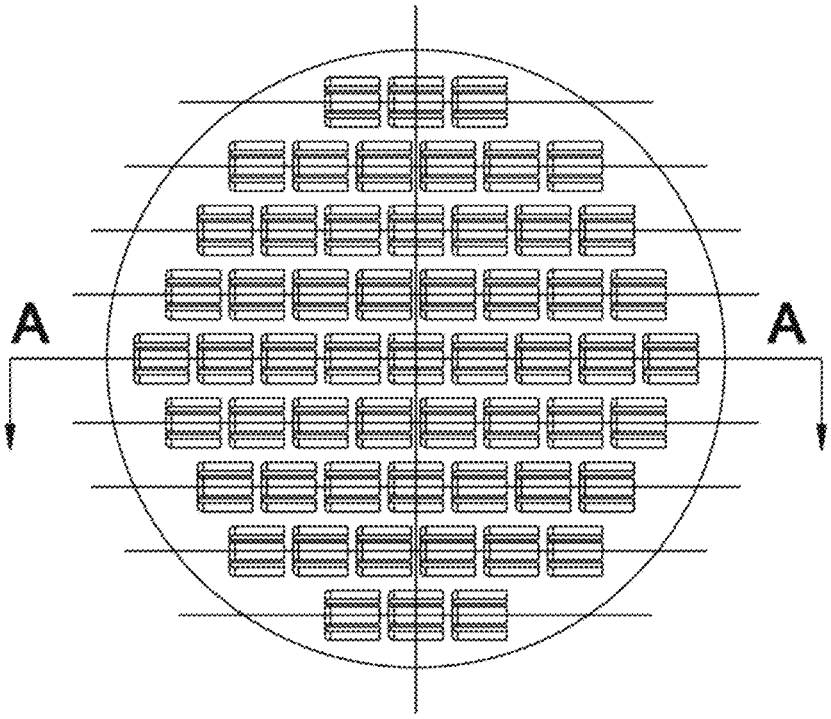
Figure 7C:
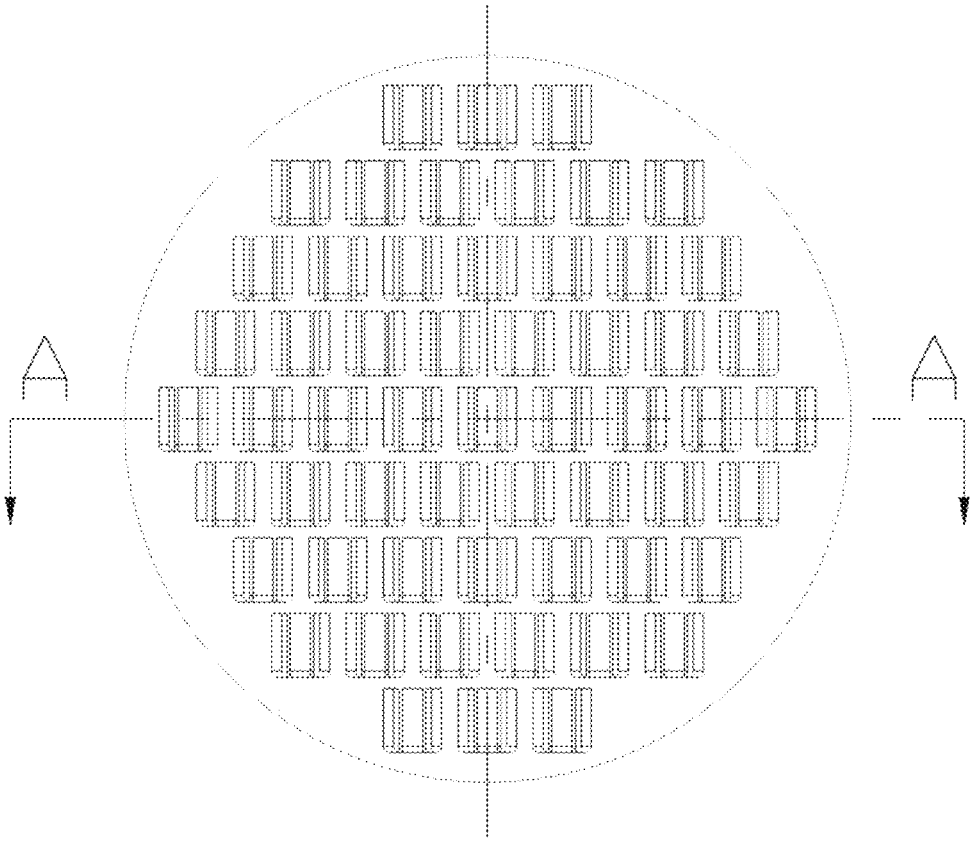

The conductive elements placed in one layer may form various lattices of conductive elements in order to adopt suitable properties. These include a square structure (lattice) providing equal distances between neighboring conductive elements disposed at the same row or at the same column as shown in FIGS. 6*a* and 6*c* for example. Alternatively, the conductive elements placed in one layer form a honeycomb or hexagonal structure (lattice) providing equal distances between any neighboring conductive elements as shown in FIGS. 7*a*-7*c*. Alternatively, the conductive elements placed in one layer form a sunflower structured lattice constituted of radial circles as shown in FIG. 10*a* for example.

FIG. 7*a* shows the top view of the first layer of a cylindrical lens where conductive elements shown in FIG. 3*b* are placed in rows and axes of the conductive elements are directed perpendicular to the layer. Distances between neighboring conductive elements are equal.

FIG. 7*b* shows the top view of the second layer of a cylindrical lens where conductive elements shown in FIG. 3*b* are placed in rows and axes of the conductive elements are directed in parallel to the layer and along of rows. Distances between neighboring conductive elements are equal.

FIG. 7*c* shows the top view of the third layer of a cylindrical lens where conductive elements shown in FIG. 3*b* are placed in rows and axes of the conductive elements are directed in parallel to the layer and perpendicular to rows. Distances between neighboring conductive elements are equal.

Figure 7D:
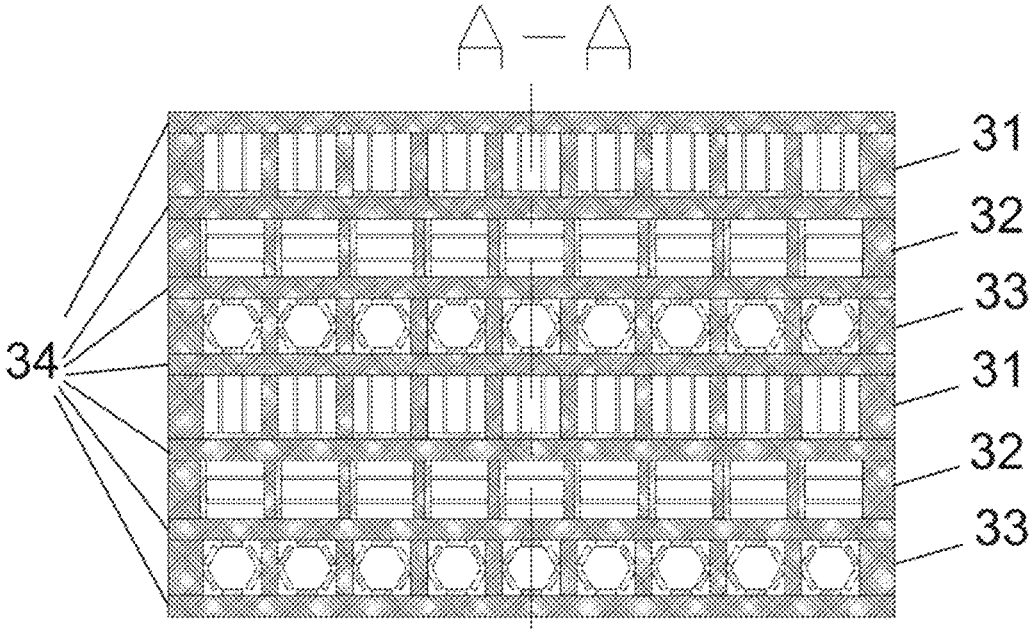
FIG. 7*d* shows a cross section of a cylindrical lens according to the invention comprising six layers corresponding to FIGS. 7*a*-7*c;*

FIG. 7*d* shows the cross section of a cylindrical lens comprising six layers of sheets comprising the conductive elements shown in FIG. 3*b*. The first layer and the fourth layer are equal. The second layer and the fifth layers are equal. The third layer and the sixth layer are equal. Thus such lens is assembled of three kinds of different layers. The conductive elements are disposed in holes made in sheets 31-33 of a foam dielectric. Sheets 31-33 containing the conductive elements are separated by sheets 34 without the conductive elements.

Figure 8A:
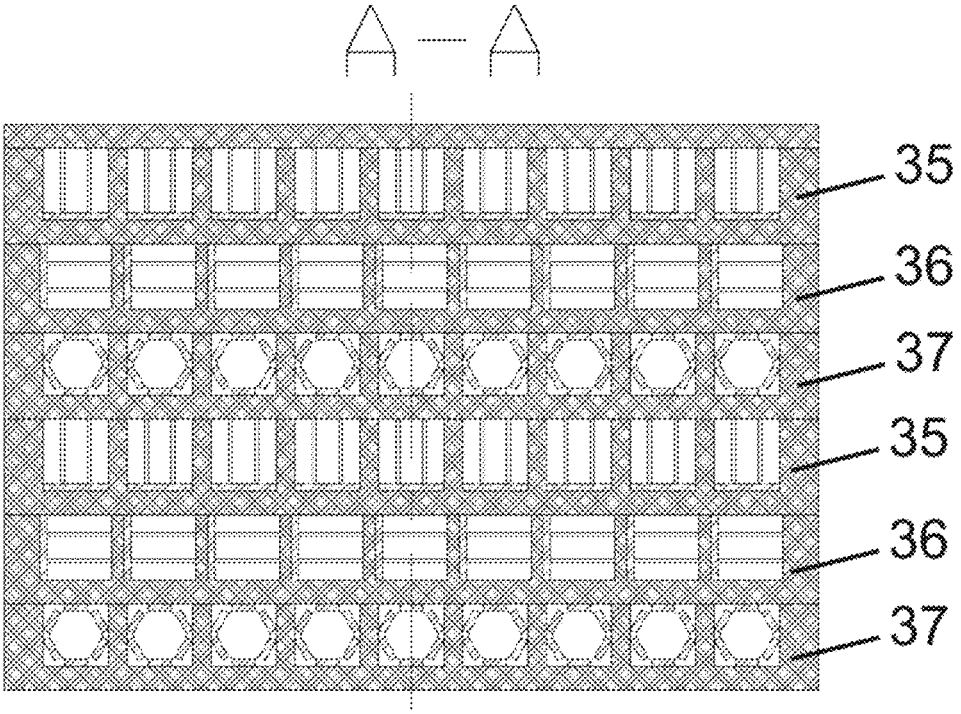
FIG. 8*a* shows a cross-section view of a cylindrical lens according to an embodiment of the invention.

FIG. 8*a* shows the cross section of a cylindrical lens comprising six layers of sheets comprising the conductive elements shown in FIG. 3*b* where holes made in sheets of a foam dielectric 35-37 are made on one surface so as to not penetrate the other side of the foam dielectric and therefore provide additional support for the conductive elements. The first layer and the fourth layer are equal. The second layer and the fifth layers are equal. The third layer and the sixth layer are equal. Thus such lens is assembled of three kinds of different layers.

Figure 8B:
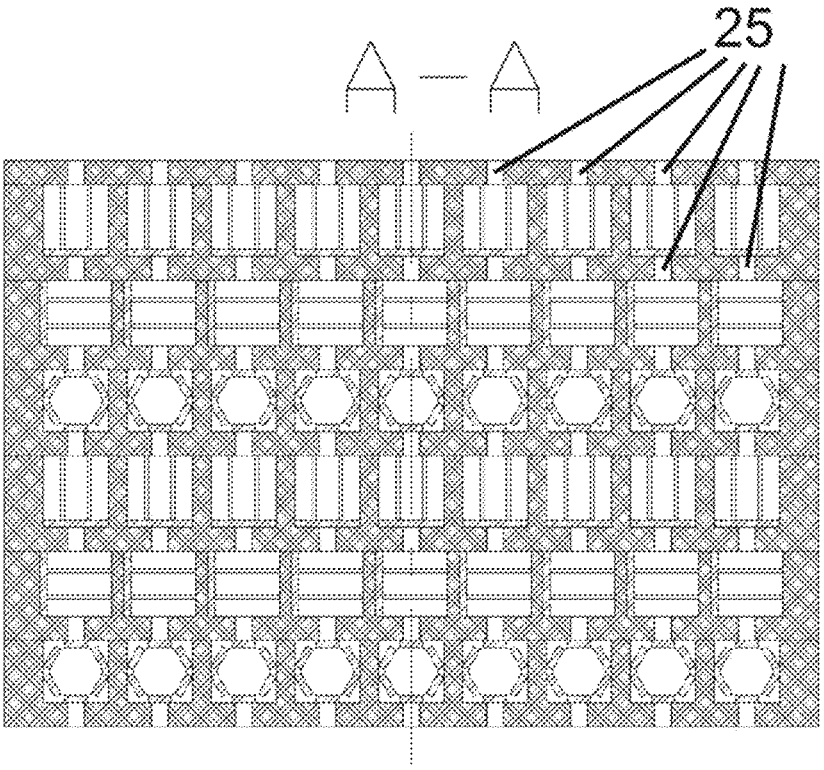
FIG. 8*b* shows a cross-section view of a cylindrical lens according to an embodiment of the invention.

FIG. 8*b* shows another embodiment of a cross section of a cylindrical lens comprising six layers of sheets comprising the conductive elements shown in FIG. 3*b* where additional holes 25 are made in the sheets of a foam dielectric corresponding to 35-37 of FIG. 8*a* to penetrate the other side of the foam dielectric to provide air ventilation through the lens.

Additionally, the holes in the dielectric material may be made so that the conductive elements may penetrate both sides of the layer. In this case, the sheets containing conductive elements are separated by intermediate sheets of dielectric material not containing conductive elements.

For other applications and end use requirements, the conductive elements placed in a layer could form other structures, and lenses may comprise other quantities and variety of different layers.

Figure 9A:
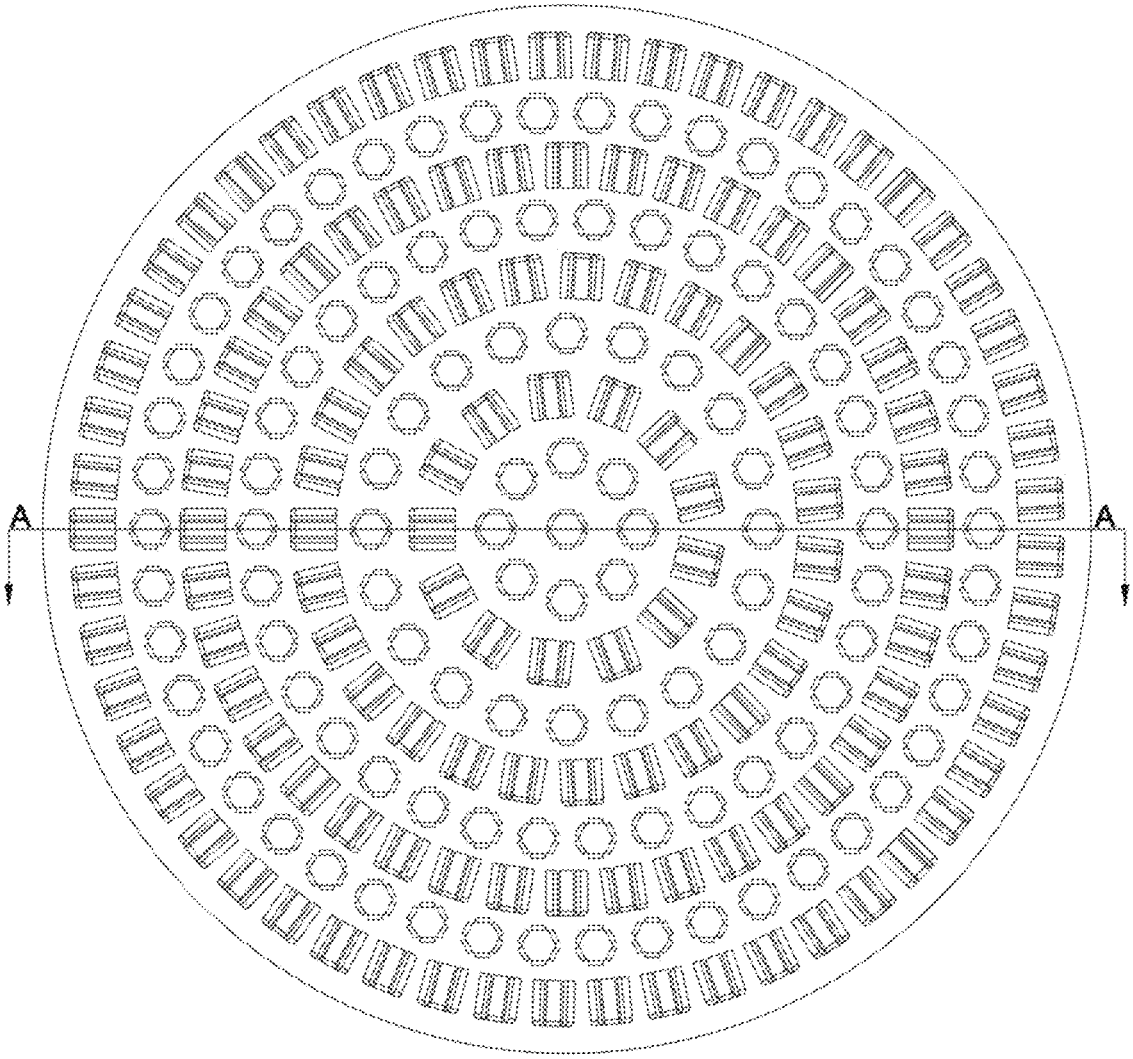
FIG. 9*a* shows a top view of a first layer of a cylindrical lens according to an embodiment of the invention.
Figure 9B:
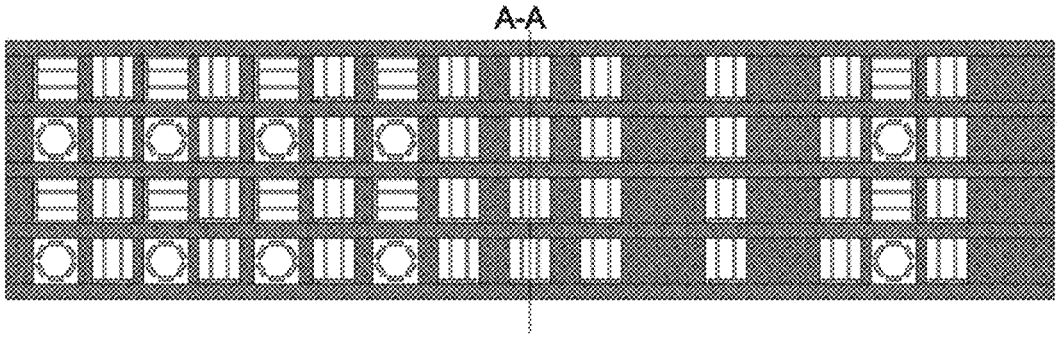
FIG. 9*b* shows a cross-section view of a cylindrical lens according to an embodiment of the invention.
Figure 9C:
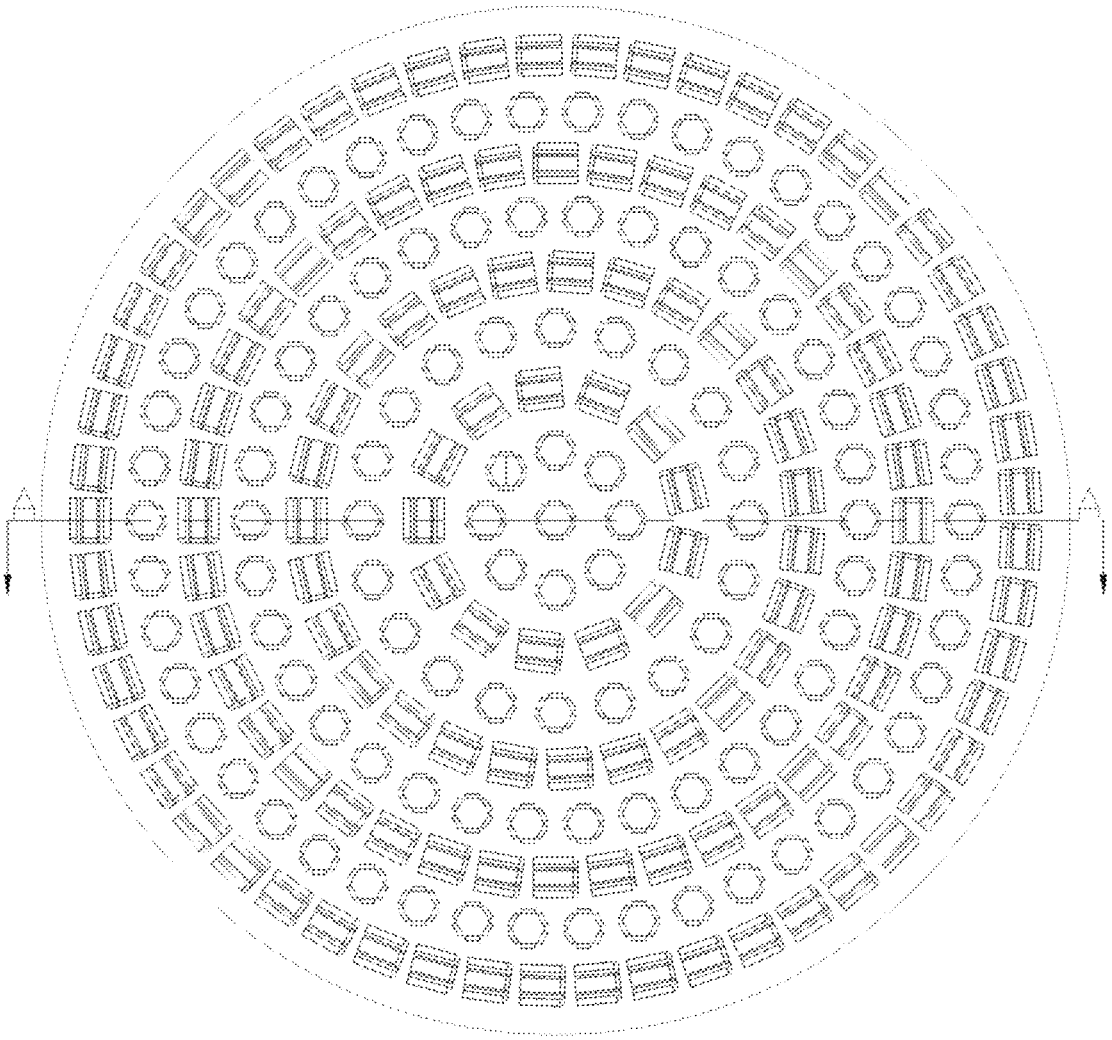
FIG. 9*c* shows a top view of a second layer of a cylindrical lens according to an embodiment of the invention.

Another embodiment of the present invention is shown in FIGS. 9*a*-9*c* where each layer of a cylindrical lens comprises a plurality of conductive elements placed in circles about the center of the cylinder. Each circle contains conductive elements sharing a common orientation in terms of either having an axis parallel with or perpendicular to the layer, however, the circles alternate between two orthogonal directions as shown in FIGS. 9*a* and 9*c*.

FIG. 9*a* shows the top view of the first layer. Axes of the conductive elements placed on the first circle closest to the outer contour of the layer of the lens are directed parallel to the layer and perpendicular to a tangent of the circle. Axes of conductive elements placed on the second circle from the outer contour of a lens are directed perpendicular to the layer.

FIG. 9*c* shows the top view of the second layer. Axes of the conductive elements placed on the first circle from the outer contour of the layer of the lens are directed parallel to the layer and parallel to a tangent to the circle. Axes of the conductive elements placed on the second circle from the outer contour of the layer of the lens are directed perpendicular to the layer.

FIG. 9*b* shows the cross section of a cylindrical lens comprising four layers of the conductive elements. The first layer and the second layer have different orientations of conductive elements placed on alternating circles. The first layer and the third layer are equal. The second layer and the fourth layers are equal. Thus such lens is assembled of two kinds of different layers.

Another embodiment of the present invention is shown in in FIGS. 10*a* to 10*d* where each layer of a cylindrical lens comprises a plurality of the conductive elements placed in circles.

FIG. 10*a* shows the top view of the first layer of a cylindrical lens where conductive elements are placed in circles and the axes of the elements are directed perpendicular to the layer. The top view of the second layer is shown in FIG. 10*c* where conductive elements are placed in circles and the axes of the elements are directed parallel to the layer and perpendicular to tangents to the circles. The top view of the third layer is shown in FIG. 10*d* where conductive elements are placed in circles and the axes of the elements are directed parallel to the layer and parallel to tangents to the circles.

Figure 10B:
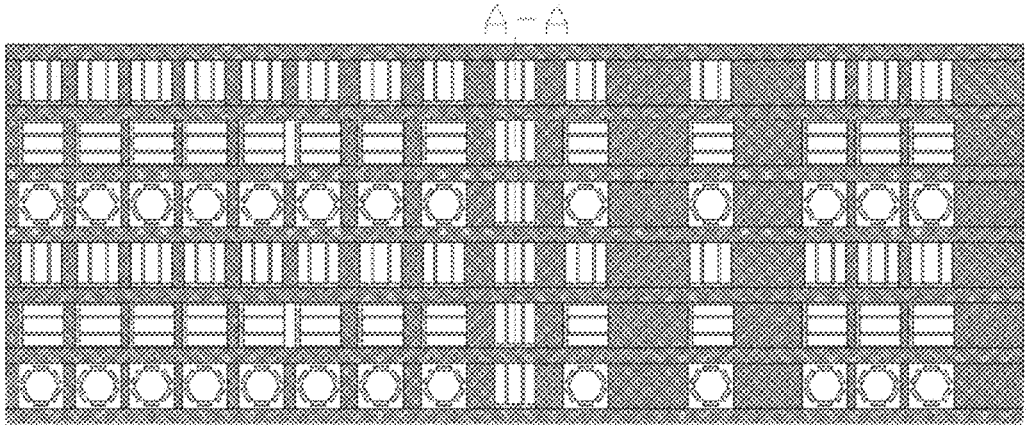
FIG. 10*b* shows a cross-section view of a cylindrical lens according to an embodiment of the invention.
Figure 10C:
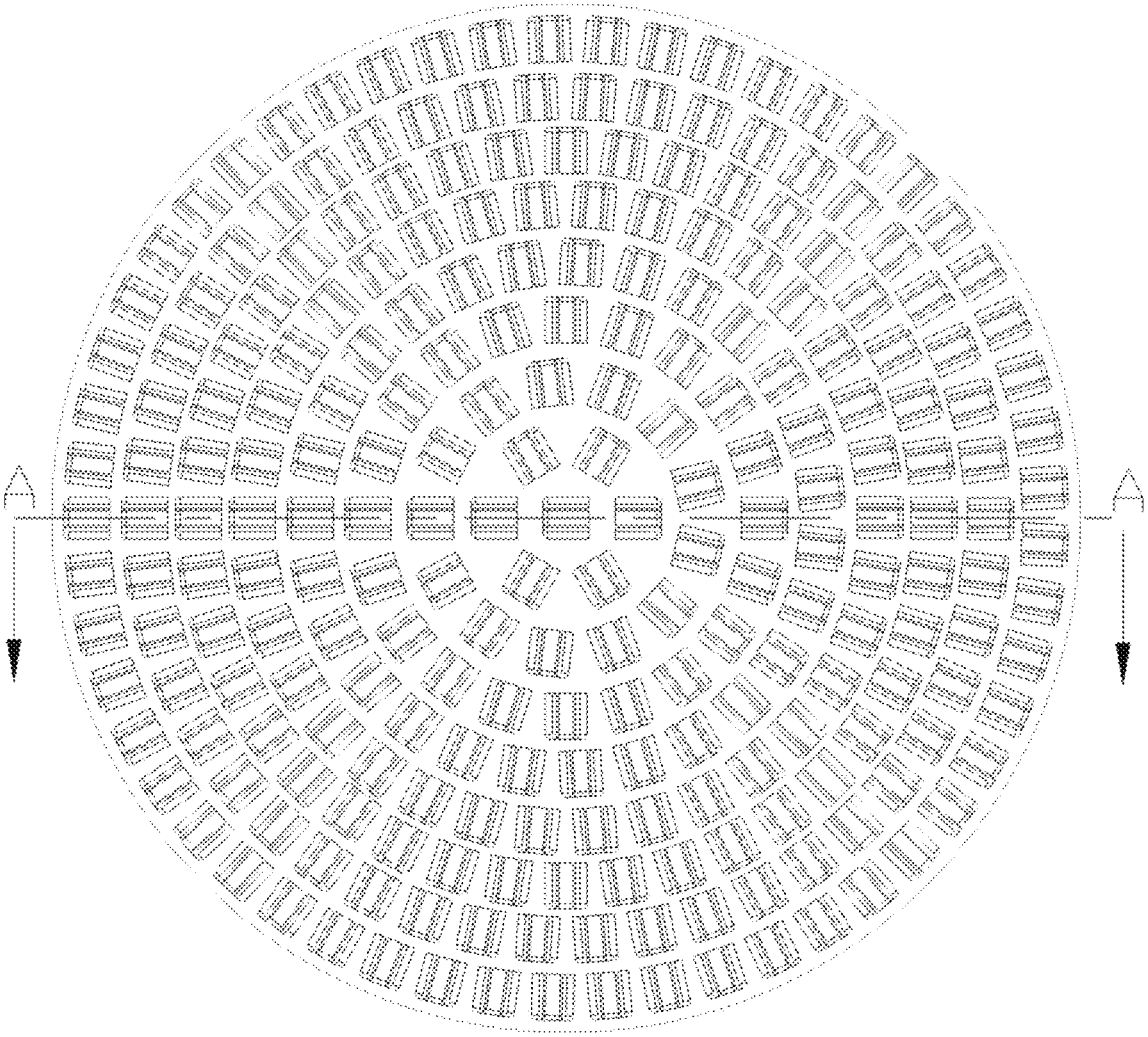
FIG. 10*c* shows the top view of the second layer of a cylindrical lens according to the embodiment of the invention shown in FIG. 10*b;*
Figure 10D:
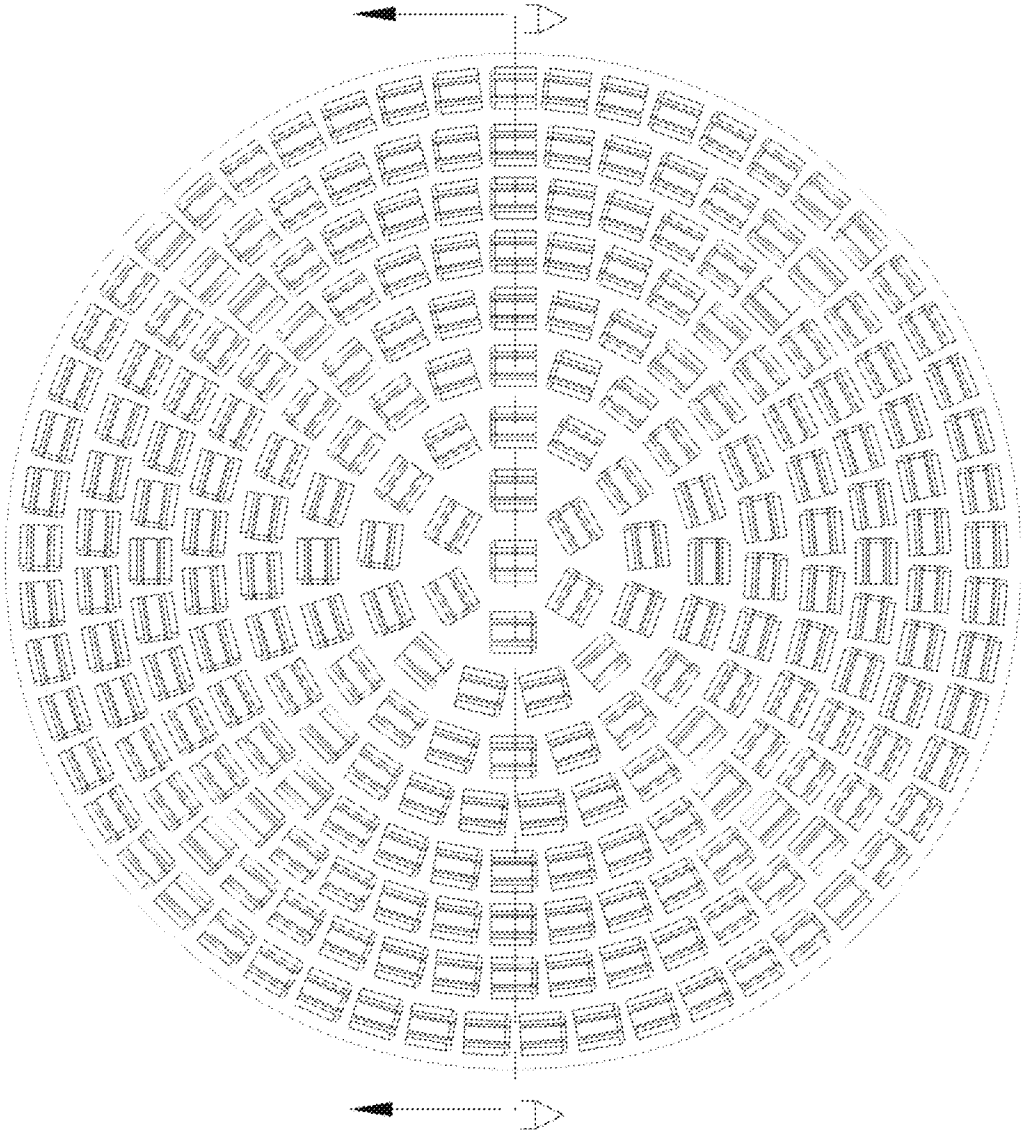
FIG. 10*d* shows the top view of the third layer of a cylindrical lens according to the embodiment of the invention shown in FIG. 10*b;*

FIG. 10*b* shows the cross section of a cylindrical lens comprising six layers of the conductive elements. The first layer and the fourth layer are equal and correspond to FIG. 10*a*. The second layer and the fifth layers are equal and correspond to FIG. 10*c*. The third layer and the sixth layer are equal and correspond to FIG. 10*d*. Thus such lens is assembled of three kinds of different layers.

Figure 11A:
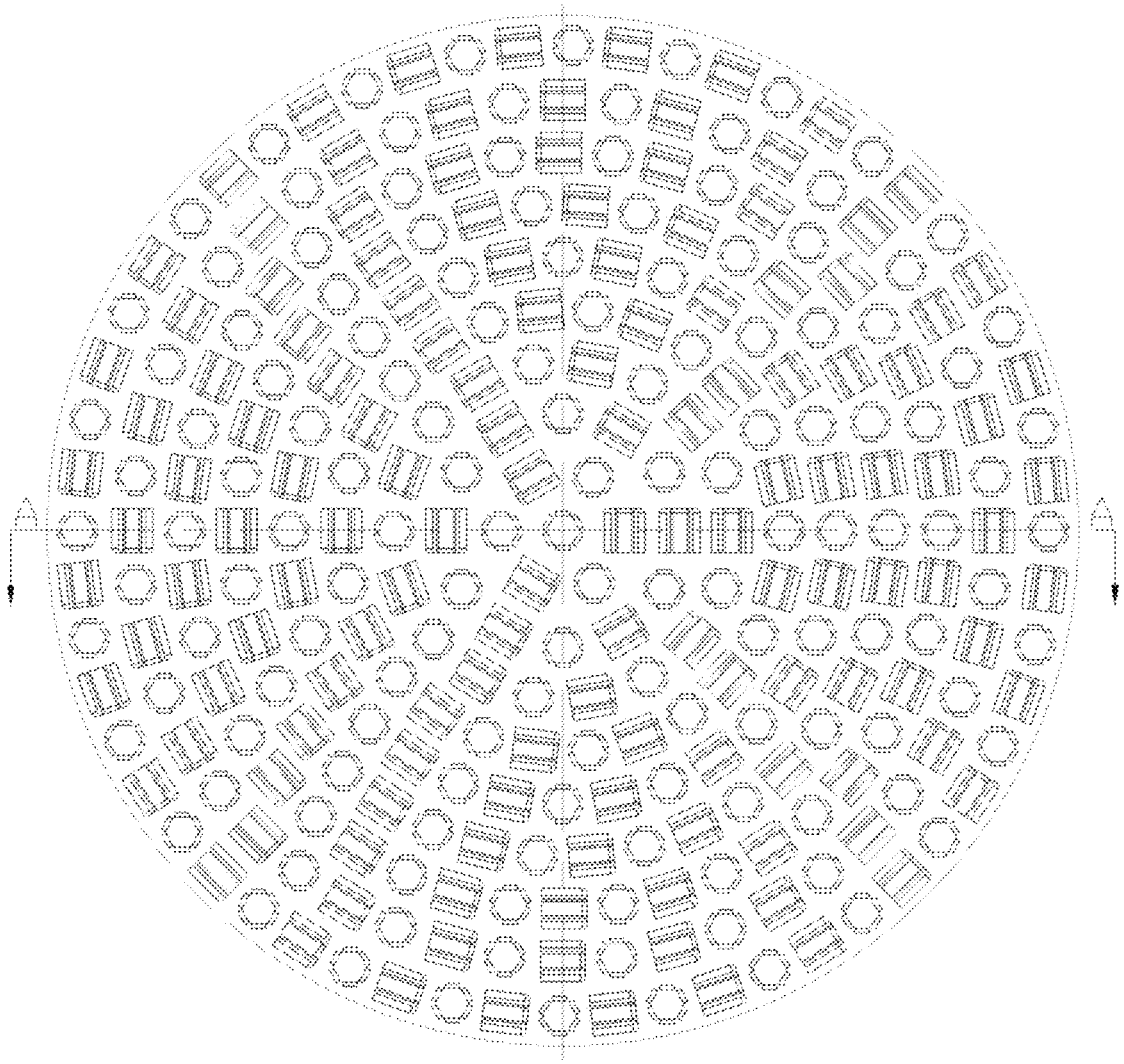
FIG. 11*a* shows the top view of the first layer of a cylindrical lens according to an embodiment of the invention.
Figure 11B:
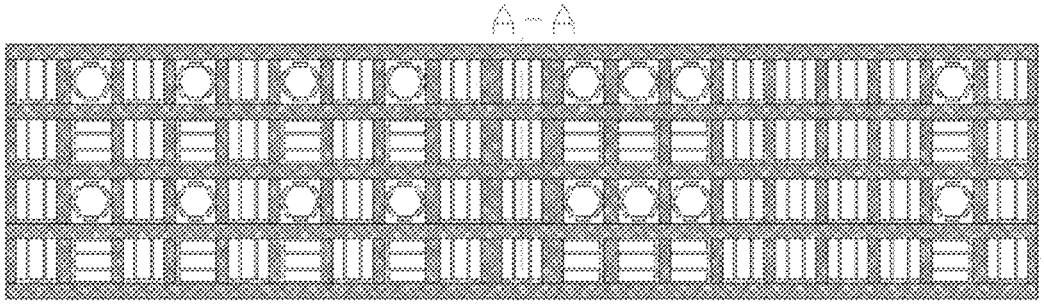
FIG. 11*b* shows a cross-section view of a cylindrical lens according to an embodiment of the invention.
Figure 11C:
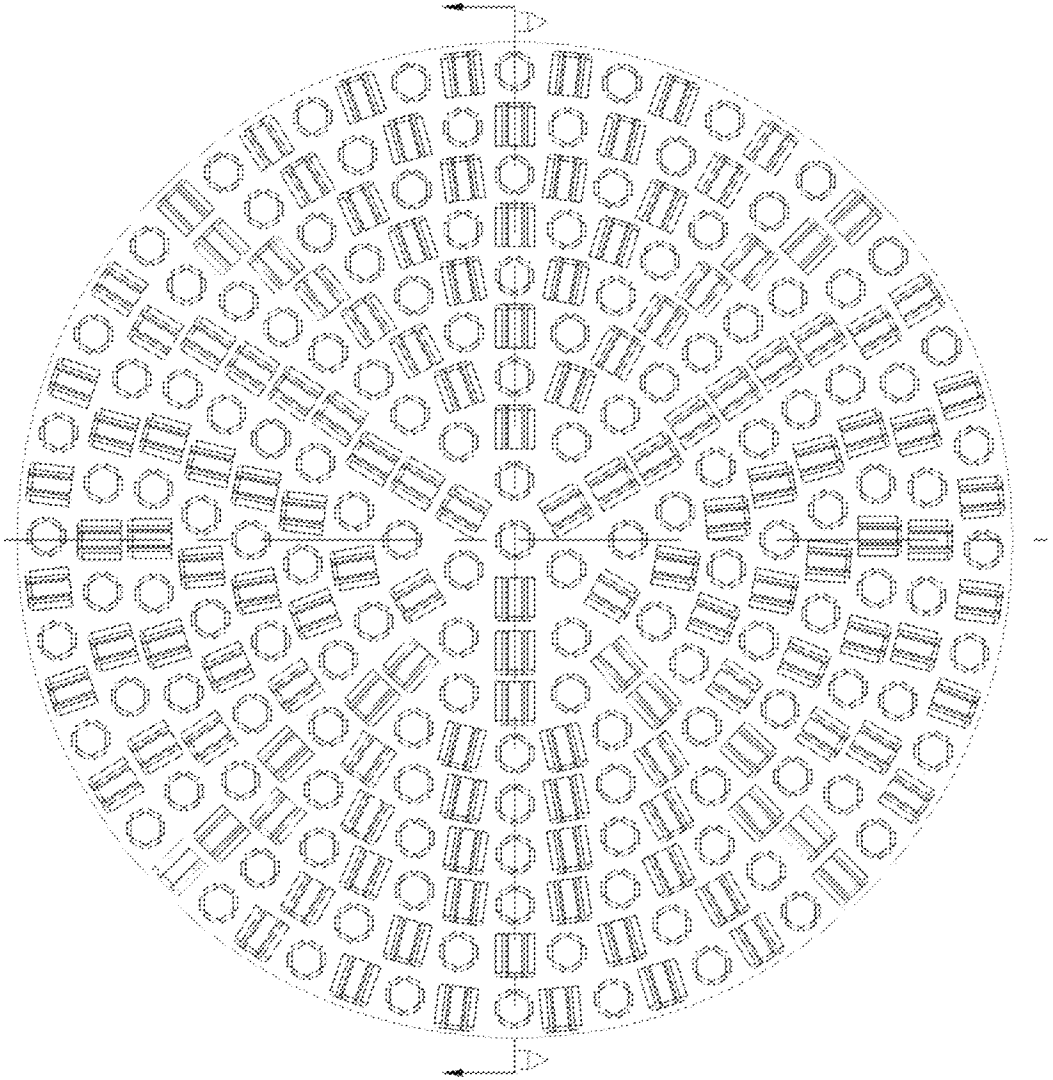
FIG. 11*c* shows the top view of the second layer of a cylindrical lens according to the embodiment of the invention shown in FIG. 11*b;*

Another embodiment of the present invention is shown in FIGS. 11*a* to 11*c* where each layer of a cylindrical lens comprises a plurality of conductive elements placed in circles and where the conductive elements have two orthogonal orientations of their axes.

FIG. 11*a* shows the top view of the first layer of a cylindrical lens where the conductive elements are configured in radial circles with alternating conductive elements positioned orthogonally similar to the structure shown in FIGS. 6*e* and 6*f*. The conductive elements are placed in circles and each circle contains conductive elements with axes directed perpendicular to the layer and conductive elements with axes directed in parallel to the layer and parallel to a tangent to the circle.

FIG. 11*c* shows the top view of the second layer of a cylindrical lens where the conductive elements are configured in radial circles with alternating conductive elements positioned orthogonally similar to the structure shown in FIGS. 6*e* and 6*f*. The conductive elements are placed in circles and each circle contains conductive elements with axes directed perpendicular to the layer and conductive elements with axes directed in parallel to the layer and perpendicular to a tangent to the circle.

FIG. 11*b* shows the cross section of a cylindrical lens comprising four layers of the conductive elements. Conductive elements of the first layer with axes directed in parallel to the layer are also parallel with a tangent to the circle in which they are placed. Conductive elements of the second layer with axes directed in parallel to the layer are also directed parallel with a tangent to the circle in which they are placed. The first layer and the third layer are equal. The second layer and the fourth layers are equal. Thus such lens is assembled of two kinds of different layers.

Figure 12A:
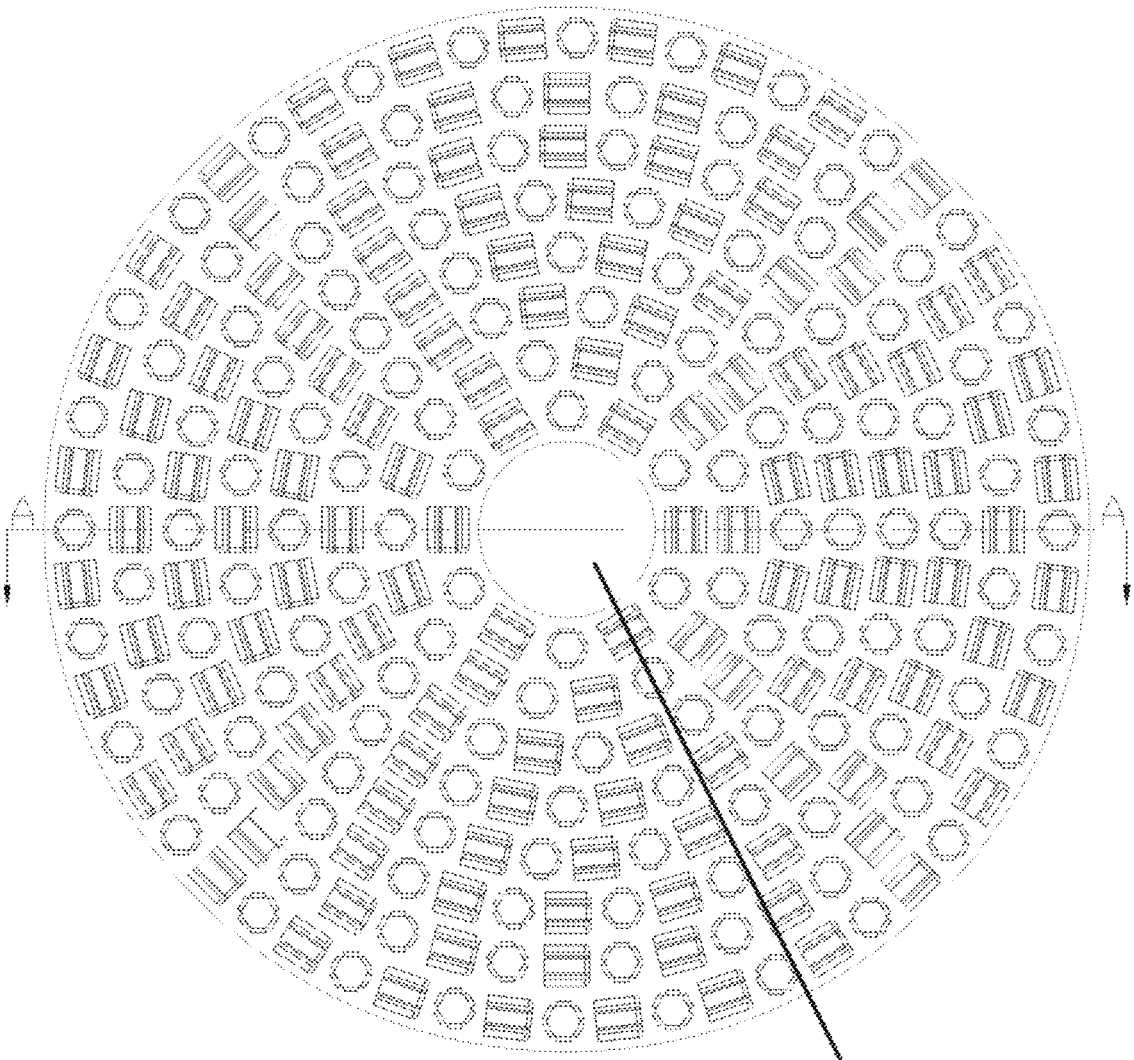
FIG. 12*a* shows the top view of the first layer of a cylindrical lens including a central rod according to an embodiment of the invention.
Figure 12B:
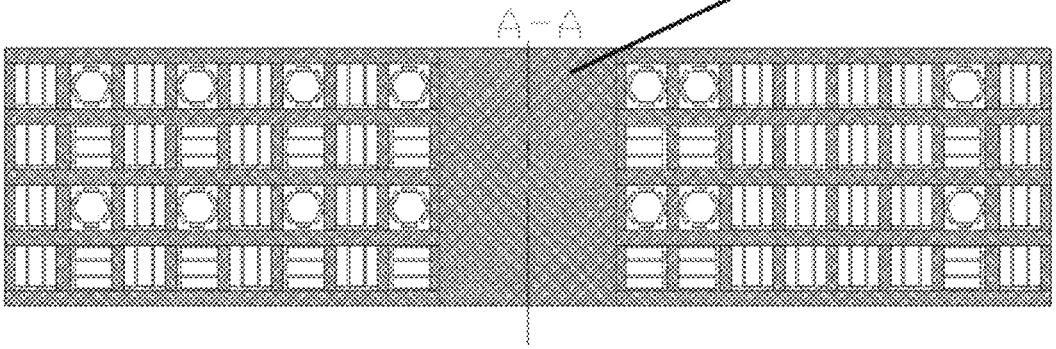
FIG. 12*b* shows a cross-section view of a cylindrical lens including a central rod according to an embodiment of the invention.
Figure 12C:
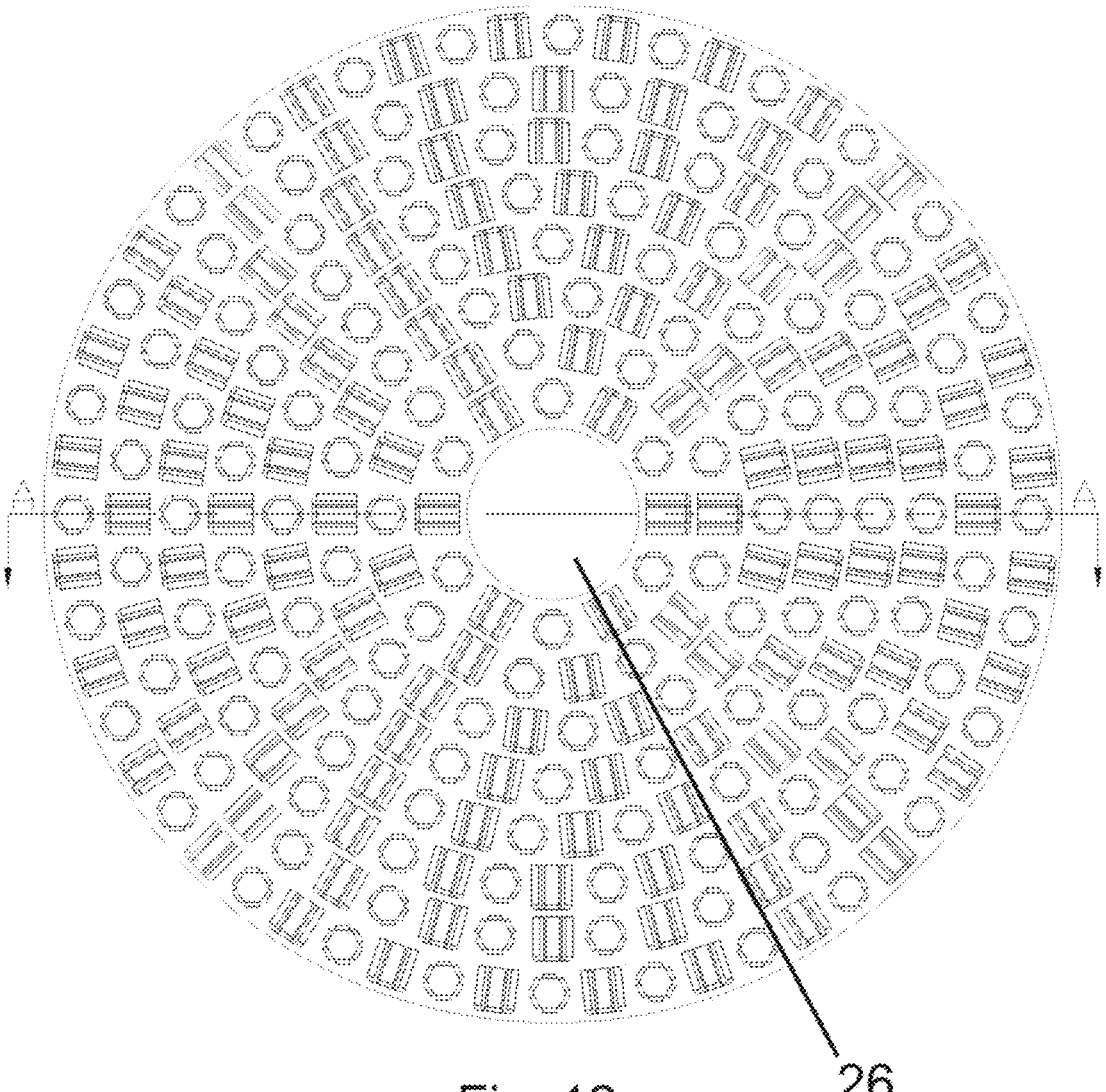
FIG. 12*c* shows the top view of the second layer of a cylindrical lens including a central rod according to the embodiment of the invention shown in FIG. 12*b;*

Another embodiment of the present invention is shown in FIGS. 12*a* to 12*c* where a cylindrical lens made of the provided artificial dielectric material comprises a central rod 26 made of a dielectric material and placed in the middle (central axis) of the cylindrical lens. Such rod increases delay coefficient n in the middle of such cylindrical lens and provides mechanical support to lightweight dielectric sheets forming a lens. Layers of the cylindrical lens shown in FIGS. 12*a* and 12*c* have the same structure as layers of the cylindrical lens shown in FIGS. 11*a* and 11*c*.

Figure 13A:
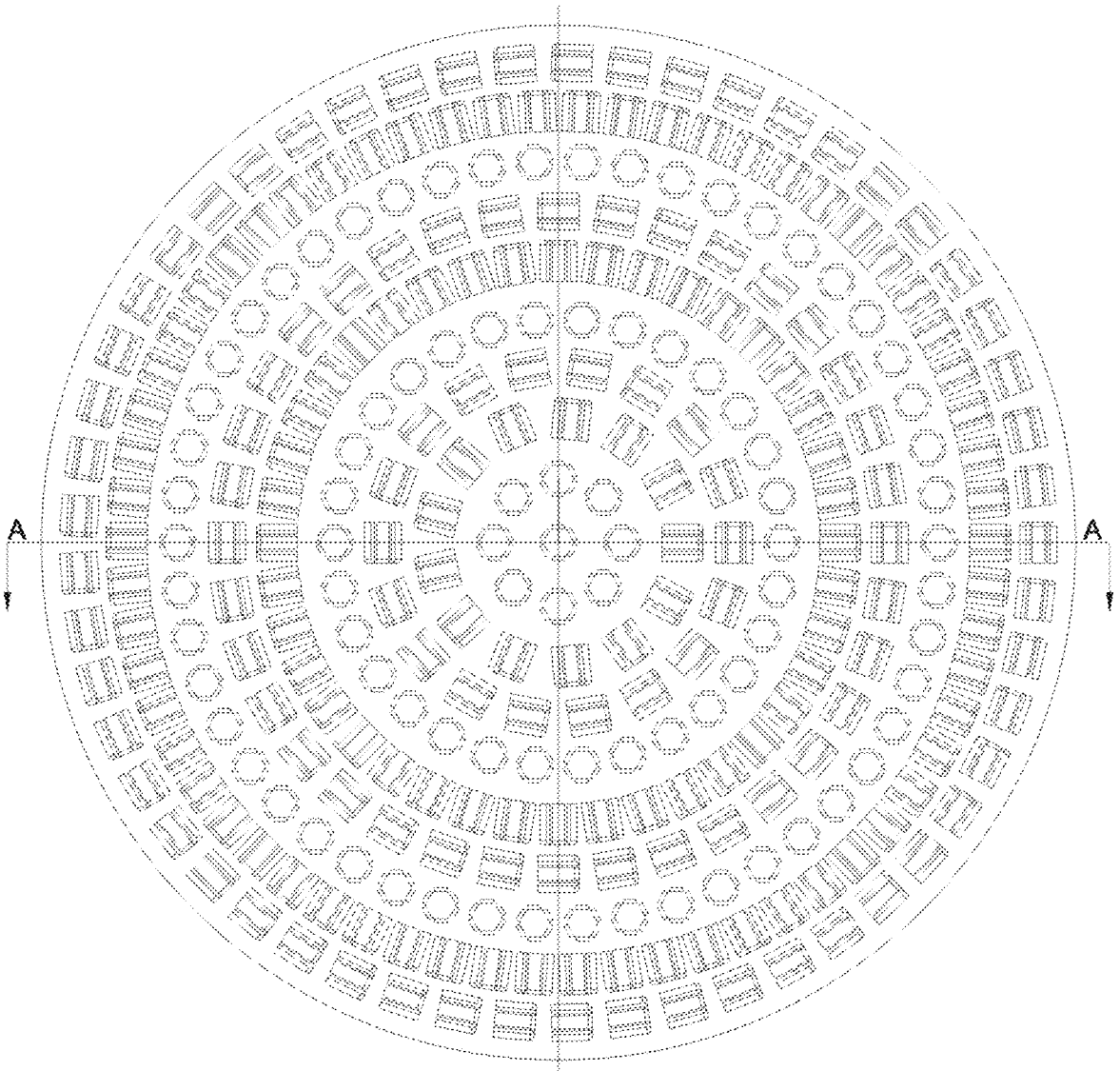
FIG. 13*a* shows the top view of the first layer of a cylindrical lens according to an embodiment of the invention.
Figure 13B:
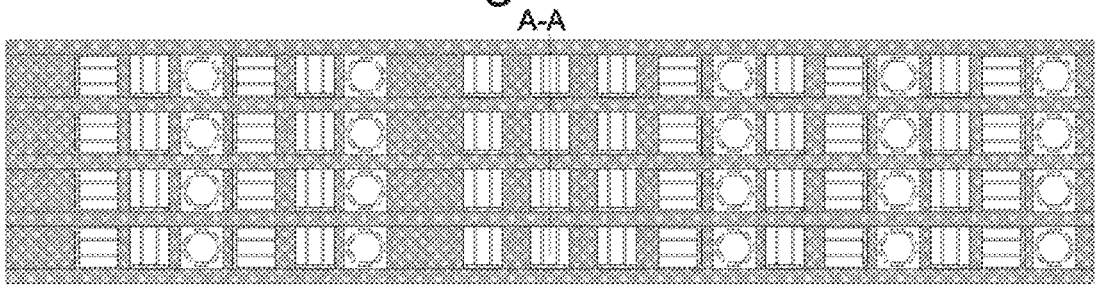
FIG. 13*b* shows a cross-section view of a cylindrical lens according to an embodiment of the invention.

Another embodiment of the present invention is shown in FIGS. 13*a* and 13*b* where each layer of a cylindrical lens comprises a plurality of conductive elements placed in circles and having three orthogonal orientations of its axes.

FIG. 13*a* shows the top view of a layer of such a cylindrical lens. The axes of conductive elements placed on the first circle from the outer contour of the layer of the lens are directed in parallel to the layer and parallel to or aligned with a tangent to the circle. The axes of conductive elements placed in the second circle from the outer contour of the lens are directed in parallel to the layer and perpendicular to a tangent to the circle. The axes of the conductive elements placed in the third circle from the outer contour of the layer of the lens are directed perpendicular to the layer. The axes of conductive elements forming the first, fourth and seventh circles are directed in parallel to or aligned with a tangent to the respective circles. The axes of conductive elements forming the second, fifth and eight circles are directed perpendicular to a tangent to the respective circles. The axes of conductive elements forming the third, sixth and ninth circles are directed perpendicular to the layer and these conductive elements are shorter than other conductive elements forming the layer.

FIG. 13*b* shows the cross section of a cylindrical lens containing four equal layers shown in FIG. 13*a*. Thus such lens is assembled of layers of one kind only. However, differing layers could also be used in addition to the three variations in conductive material orientation in a single layer.

The above described cylindrical lenses contain the conductive elements shown in FIG. 3*b* only to simplify drawings. The conductive elements shown in other figures such as FIGS. 2*a*-4*b*, amongst other configurations not depicted can be used in any described above cylindrical lenses and the layers of artificial dielectric material which comprise them.

A group of focusing lenses which could be created of the provided artificial dielectric material is not limited by described above embodiments. Layers of focusing lenses could be formed by other structures also. For example by the structures shown in FIGS. 6*g* and 6*h* where axes of conductive elements forming each row are directed to three orthogonal directions. If the conductive elements forming one layer of a cylindrical lens will be placed in radial circles, each circle may contain the conductive elements having three orthogonal directions of axes. Such lenses could be assembled of layers of one kind only. Conductive elements forming a layer could be equal or have different dimensions. Distances between conductive elements forming a layer could be equal and form structure providing permanent delay coefficient n along a layer. Distances between conductive elements forming a layer could be continuously increased towards the outer contour of a lens. Distances between conductive elements forming a layer could be not equal and form several areas providing different delay coefficient n along a layer. Such layers, as shown in FIGS. 5-7 of NZ patent application 752904 are formed by tubes having axes directed perpendicular to the layer. As delay coefficient n depends on the angle between direction of electromagnetic wave crossing the material and the axes of tubes, such artificial dielectric material doesn't suit for many applications requiring isotropic dielectric material providing the same value of delay coefficient n for any direction and polarization of electromagnetic wave. The provided artificial dielectric material containing conductive elements having three orthogonal directions of axes is suitable for manufacturing spherical Luneburg lenses which have to be made of isotropic dielectric material having the same delay coefficient n for any direction and polarization of electromagnetic wave.

Figure 14A:
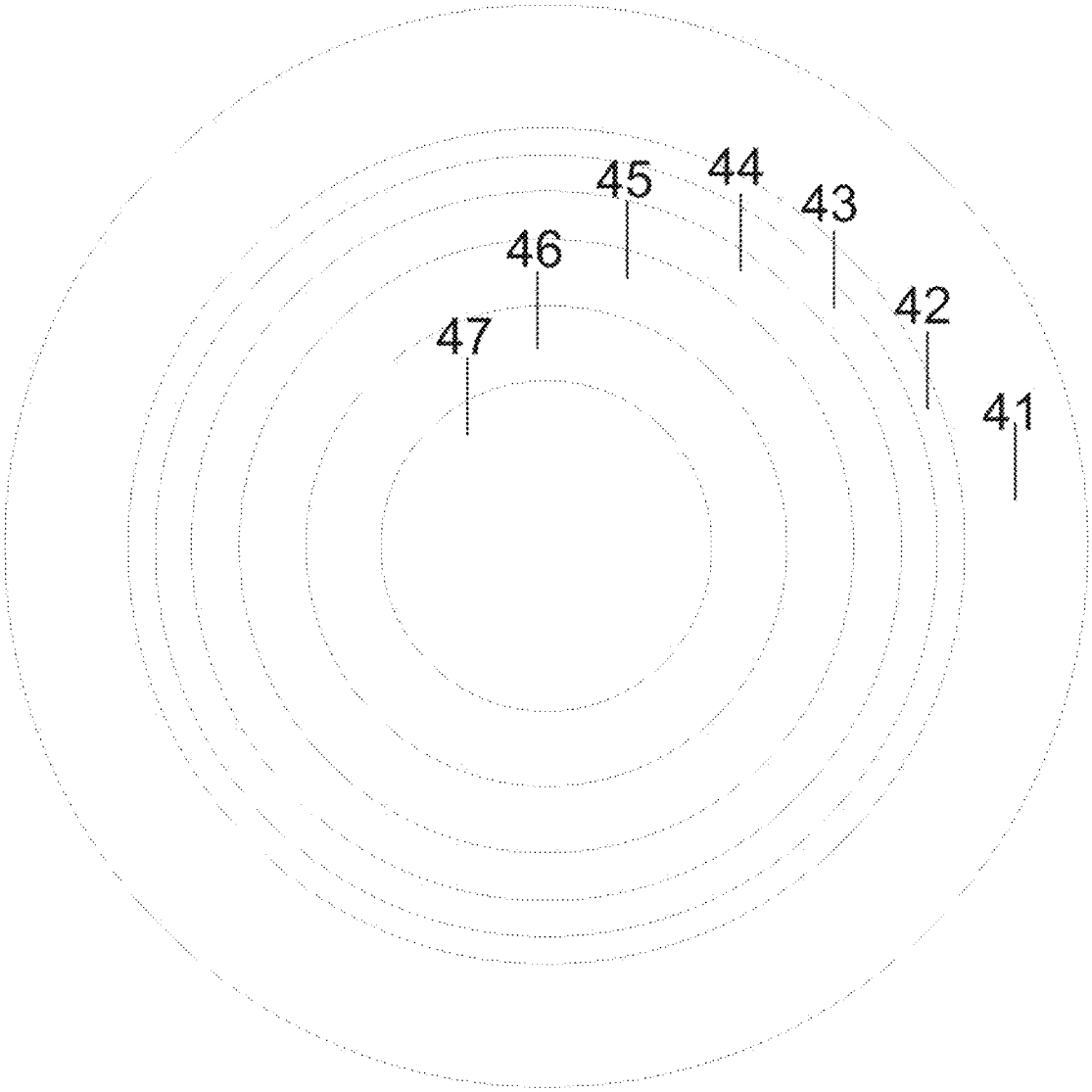
FIG. 14*a* shows the top view of a spherical lens according to an embodiment of the invention.

FIG. 14*a* shows the top view of a spherical lens according to an embodiment of the invention. The lens is assembled of circular sheets of foam dielectric containing the conductive elements. The sheets of a foam dielectric 41-47 having different diameters are stacked together and form the outer contour of the lens generally resembling the shape of a sphere.

Figure 14B:
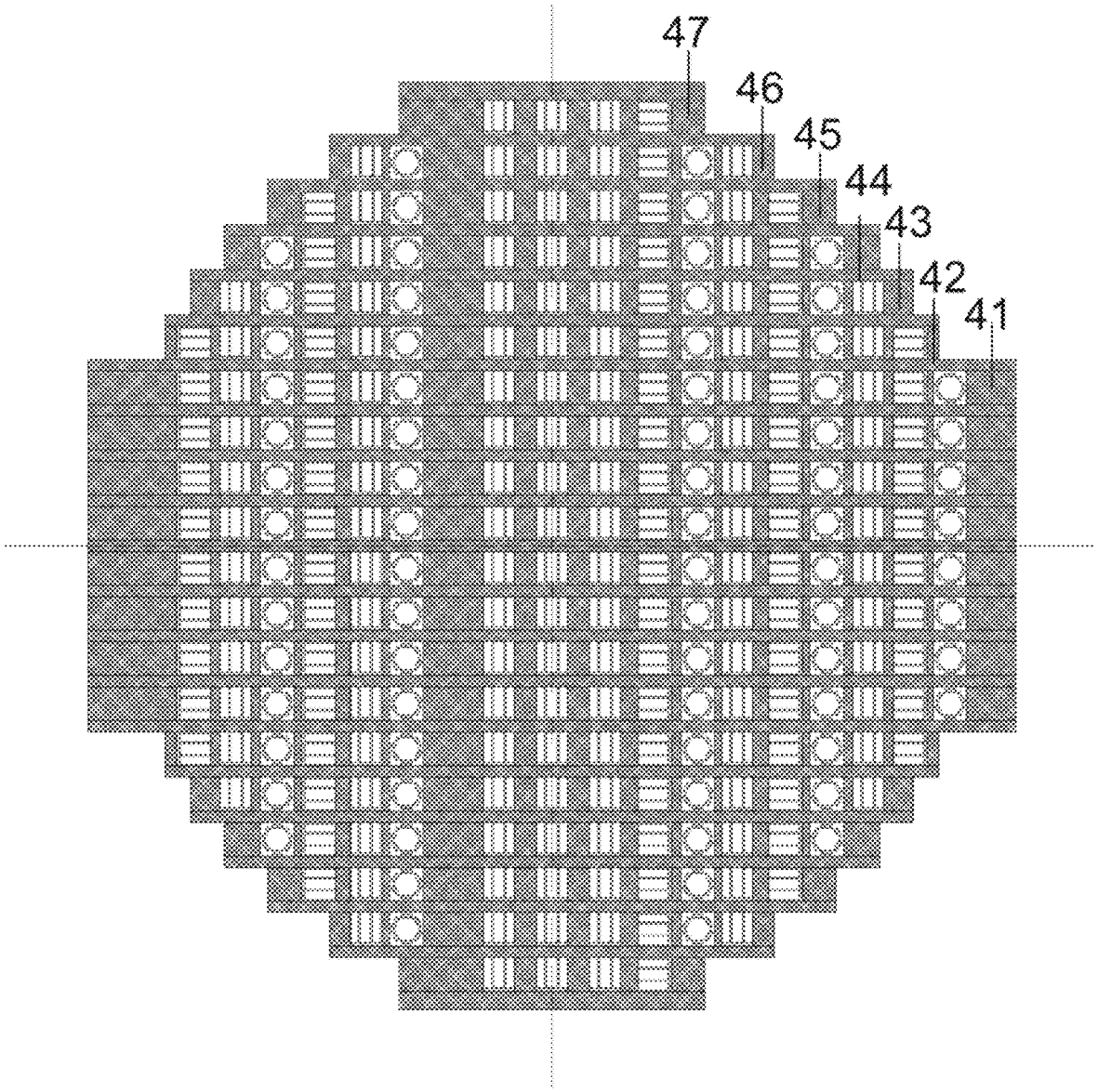
FIG. 14*b* shows a cross-section view of a spherical lens according to an embodiment of the invention.

FIG. 14*b* shows a cross-section view of a spherical lens according to an embodiment of the invention. The central part of spherical lens contains the sheets of a foam dielectric 41 containing the conductive elements disposed as shown in FIG. 13*a*. The sheets 42-47 have progressively reduced diameter and less circles of the conductive elements than the sheet 41, however, the configuration of the particles of the layers is equivalent as depicted in FIG. 14*b*.

Such spherical lens can effectively form a beam having a 20-40 degree half power beam width. Large spherical lenses forming narrower beams have increased distances between the conductive elements towards the outer contour of the sphere.

The invention also relates to a method for manufacturing artificial dielectric materials which may be in turn used in the production of lenses comprised of multiple layers of the artificial dielectric materials. The method involves placing conductive elements in holes in a plurality of sheets of a dielectric material, and stacking said sheets together, wherein the sheets of the dielectric material containing the conductive elements are separated by sheets of the dielectric material without the conductive elements, and wherein axes of the conductive elements are orientated along at least two different directions. As an alternative, the sheets not containing the dielectric material may be omitted and the sheets containing the conductive element may have holes which do not pass through the thickness of the sheet. In such manner, the conductive elements of each layer may be kept separated as is desired.

The conductive elements may be placed into pre-existing holes in the sheets of the dielectric material. Further, the manufacturing process may require that the outer parts of the conductive elements are bent at the time of being placed into pre-existing holes in the sheets of the dielectric material. Alternatively, conductive elements which have been preformed into their required shape may be placed into the holes at the time of assembly.

The invention also relates to a method of focusing a radio wave using a focusing lens according to the invention. Such lens may be spherical or cylindrical or may have another geometry. Use of such a focusing lens comprising the artificial dielectric material and conductive elements according to the invention allows focusing of radio waves with less dependence on direction and polarization of electromagnetic waves.

While some preferred aspects of the invention have been described by way of example, it should be appreciated that modifications and/or improvements can occur without departing from the scope of the invention as claimed in this specification.

The terms comprise, comprises, comprising or comprised, if and when used herein, should be interpreted non-exclusively, that is, as conveying "consisting of, or including".

It is to be understood that, if any prior art publication is referred to herein, such reference does not constitute an admission that the publication forms a part of the common general knowledge in the art, in New Zealand or any other country.

The invention claimed is:

1. An artificial dielectric material comprising a plurality of sheets of a foam polymer dielectric material and a plurality of conductive elements disposed in holes made in the sheets of the dielectric material, wherein each conductive element is a three-dimensional object consisting of a plurality of side plates connected to a central support but separated from each other and disposed to form conductive surfaces surrounding an empty space.

2. The artificial dielectric material according to claim 1, wherein the side plates are disposed either perpendicular or non-perpendicular to the support part.

3. The artificial dielectric material according to claim 1, wherein at least one surface of the conductive element is covered by a dielectric film.

4. The artificial dielectric material according to claim 1, wherein at least one surface of the conductive element is covered by a conductive film.

5. The artificial dielectric material according to claim 1, wherein the holes in the dielectric material contain projections disposed in the gaps separating the outer parts of the conductive elements.

6. The artificial dielectric material according to claim 1, wherein the central support of the conductive element contains a cruciform slot or a hole.

7. The artificial dielectric material according to claim 1 wherein axes of the conductive elements are orientated along at least two different directions.

8. The artificial dielectric material according to claim 7, wherein the at least two different directions are orthogonal directions.

9. The artificial dielectric material according to claim 1, wherein the conductive elements have at least two different shapes.

10. The artificial dielectric material according to claim 1, wherein the conductive elements have a shape of a half of an empty sphere containing slots cutting a surface of the sphere in order to provide side plates.

11. The artificial dielectric material according to claim 1, wherein the foam polymer is made of a material selected from polyethylene, polystyrene, polypropylene, polyurethane, silicon and polytetrafluoroethylene.

12. The artificial dielectric material according to claim 1, wherein the conductive elements disposed in one layer form a square lattice providing equal distances between neighboring conductive elements disposed at the same row or at the same column.

13. The artificial dielectric material according to claim 1, wherein the conductive elements disposed in one layer form a honeycomb (hexagonal) lattice providing equal distances between any neighboring elements.

14. The artificial dielectric material according to claim 1, wherein axes of the conductive elements disposed in one layer are directed at the same direction.

15. The artificial dielectric material according to claim 1, wherein axes of the conductive elements disposed in one layer are directed perpendicular to the layer.

16. The artificial dielectric material according to claim 1, wherein axes of the conductive elements disposed in one layer are directed parallel to the layer.

17. The artificial dielectric material according to claim 1, wherein axes of some conductive elements disposed in one layer are directed perpendicular to the layer and axes of other conductive elements are directed in parallel to the layer.

18. The artificial dielectric material according to claim 17, wherein axes of the conductive elements directed in parallel to the layer are directed in different directions.

19. A focusing lens comprising an artificial dielectric material according to claim 1.

20. The focusing lens according to claim 19, wherein the conductive elements of each layer form a sunflower (radial circle) lattice.

21. The focusing lens according to claim 20, wherein each layer contains circles of conductive elements having axes directed perpendicular to the layer and circles of conductive elements having axes directed in parallel to the layer.

22. The focusing lens according to claim 20, wherein at least one circle contains conductive elements having axes directed in parallel to the layer and in parallel to the circle.

23. The focusing lens according to claim 20, wherein at least one circle contains conductive elements having axes directed in parallel to the layer and perpendicular to the circle.

24. A method of focusing a radio wave using a focusing lens according to claim 20.

25. The focusing lens according to claim 19, comprising layers with the conductive elements having axes directed only perpendicular to the layer and layers containing conductive elements having axes directed only in parallel to the layer.

26. The focusing lens according to claim 19, wherein the axes of the conductive elements of the layer containing the conductive elements with axes directed only in parallel to the layer are directed in perpendicular to axes of the conductive elements of another layer containing the conductive elements with axes directed in parallel to the layer.

27. The focusing lens according to claim 19, wherein each layer contains conductive elements with axes directed perpendicular to the layer and conductive elements with axes directed in parallel to the layer.

28. The focusing lens according to claim 19, wherein axes of conductive elements directed in parallel to the layer and displaced at even layers are directed perpendicular to axes of conductive elements directed in parallel to the layer and displaced at odd layers.

29. The focusing lens according to claim 19, wherein a dielectric rod is placed along the longitudinal axis of the focusing lens.

30. The focusing lens according to claim 19, wherein the lens is cylindrical.

31. The focusing lens according to claim 19, wherein the lens is spherical.

32. A method of focusing a radio wave using a focusing lens according to claim 19.

33. A method for manufacturing an artificial dielectric material according to claim 1, the method comprising placing the conductive elements in a plurality of sheets of a foam polymer dielectric material, and stacking said sheets together, wherein axes of the conductive elements are orientated along at least two different directions.

34. The method according to claim 33, wherein the conductive elements are placed into pre-existing holes in the sheets of the dielectric material.

35. The method according to claim 33, wherein the sheets of the dielectric material containing the conductive elements are separated by sheets of the dielectric material without conductive elements.

36. The method according to claim 33, wherein the sheets of the dielectric material containing the conductive elements comprise holes which do not pass through the thickness of the sheet.

37. The method according to claim 33, wherein the outer parts of the conductive elements are bent at the time of being placed into the sheets of the dielectric material.

38. A conductive element for use in an artificial dielectric material according to claim 1, the element comprising side plates connected to a central support, disposed to form conductive surfaces surrounding an empty space.

39. The conductive element according to claim 38, wherein the side plates are disposed either perpendicular or non-perpendicular to the support part.

40. The conductive element according to claim 38, wherein the side plates are connected at the outer region of the central support.

* * * * *